US010344411B2

(12) United States Patent
Maki et al.

(10) Patent No.: US 10,344,411 B2
(45) Date of Patent: Jul. 9, 2019

(54) SEWING MACHINE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventors: Ryutaro Maki, Handa (JP); Yoshiteru Aoki, Chita (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 116 days.

(21) Appl. No.: 15/714,683

(22) Filed: Sep. 25, 2017

(65) Prior Publication Data

US 2018/0010273 A1 Jan. 11, 2018

Related U.S. Application Data

(63) Continuation of application No. PCT/JP2016/068517, filed on Jun. 22, 2016.

(30) Foreign Application Priority Data

Jul. 31, 2015 (JP) ..... 2015-151932

(51) Int. Cl.
*D05B 19/02* (2006.01)
*D05C 5/02* (2006.01)
(Continued)

(52) U.S. Cl.
CPC ..... *D05B 19/02* (2013.01); *D05B 19/10* (2013.01); *D05C 5/02* (2013.01); *D05C 5/06* (2013.01)

(58) Field of Classification Search
CPC ..... D05B 19/02; D05B 19/10; D05C 5/06; D05C 5/00; D05C 3/02; D05C 11/02
See application file for complete search history.

(56) References Cited

U.S. PATENT DOCUMENTS 5,794,552 A * 8/1998 Owaki ..... D05B 19/105 112/102.5
6,237,516 B1 * 5/2001 Wakayama ..... D05B 19/105 112/102.5
(Continued)

FOREIGN PATENT DOCUMENTS

JP H02-05991 A 1/1990
JP H09-95855 A 4/1997
(Continued)

OTHER PUBLICATIONS

Feb. 6, 2018 International Preliminary Report on Patentability issued in International Patent Application No. PCT/JP2016/068517.
(Continued)

*Primary Examiner* — Danny Worrell
(74) *Attorney, Agent, or Firm* — Oliff PLC

(57) ABSTRACT

A sewing machine includes a sewing portion sewing an embroidery pattern on a cloth, a first storage portion storing the stitch data and pattern data, a display portion, a processor, and a memory storing computer-readable instructions. The computer-readable instructions, executed by the processor, includes first acquiring the stitch data and the pattern data, and first displaying, based on the pattern data, the pattern image on the display portion. The computer-readable instructions also includes, first generating a plurality of partial images representing a number of stitches corresponding to a first predetermined number, based on the stitch data, after the first displaying of the pattern image on the display portion, and second displaying, each time each of the plurality of partial images is generated by the first generating, the generated partial image on a portion of the pattern image displayed by the first displaying that corresponds to the generated partial image.

11 Claims, 11 Drawing Sheets

(51) Int. Cl.
*D05C 5/06* (2006.01)
*D05B 19/10* (2006.01)

(56) References Cited

U.S. PATENT DOCUMENTS

| | | | | |
|---|---|---|---|---|
| 2012/0209417 | A1* | 8/2012 | Tokura ..... | D05B 19/16<br>700/138 |
| 2012/0245727 | A1 | 9/2012 | Naka et al. | |
| 2016/0032508 | A1* | 2/2016 | Tokura ..... | D05B 19/08<br>112/102.5 |

FOREIGN PATENT DOCUMENTS

| | | | |
|---|---|---|---|
| JP | H11-345242 | A | 12/1999 |
| JP | 2004-242979 | A | 9/2004 |
| JP | 2004-361814 | A | 12/2004 |
| JP | 2012-200265 | A | 10/2012 |

OTHER PUBLICATIONS

Sep. 13, 2016 International Search Report issued in International Patent Application No. PCT/JP2016/068517.

* cited by examiner

SEWING MACHINE AND NON-TRANSITORY COMPUTER-READABLE MEDIUM

CROSS REFERENCE TO RELATED APPLICATION

This application is a Continuing Application of International Application No. PCT/JP2016/068517, filed Jun. 22, 2016, which claims priority from Japanese Patent Application No. 2015-151932, filed on Jul. 31, 2015. This disclosure of the foregoing application is hereby incorporated by reference in its entirety.

BACKGROUND

The present disclosure relates to a sewing machine and a non-transitory computer-readable medium.

With respect to a sewing machine capable of sewing embroidery patterns, in order to allow a user to select an embroidery pattern to be sewn, technology is disclosed in which a plurality of images showing the embroidery patterns (hereinafter referred to as "pattern images") are displayed in rows on a display portion. Hereinafter, the displaying of the plurality of pattern images in rows is also referred to as "thumbnail display of the plurality of pattern images." Further, a method is known that generates the pattern image on the basis of stitch data for sewing the embroidery pattern.

SUMMARY

When a pattern image is generated on the basis of stitch data, the larger a number of coordinates of needle drop points represented by the stitch data, the longer the amount of time required to generate the pattern image. Thus, when performing thumbnail display of a plurality of the generated pattern images, there is a possibility that the thumbnail display is not smoothly performed, due to the long amount of time required to generate the plurality of pattern images. As a result, there is a problem that a long time is required before a user can verify an embroidery pattern that is a sewing object.

It is an object of the present disclosure to provide a sewing machine and a non-transitory computer-readable medium that allow a user to verify an embroidery pattern in a short amount of time.

An aspect of the present disclosure provides a sewing machine including a sewing portion, a first storage portion, a display portion, a processor, and a memory. The sewing portion is configured to sew an embroidery pattern on a cloth, on the basis of stitch data. The stitch data includes a position of each of a plurality of stitches that represents the embroidery pattern. The first storage portion is configured to store the stitch data and pattern data. The pattern data is data of a pattern image that represents the embroidery pattern corresponding to the stitch data. The display portion is configured to display the pattern image. The memory is configured to store computer-readable instructions. The computer-readable instructions, when executed by the processor, instruct the processor to perform processes comprising first acquiring, first displaying, first generating, and second displaying. The first acquiring acquires the stitch data and the pattern data from the first storage portion. The first displaying displays the pattern image on the display portion on the basis of the pattern data acquired by the first acquiring. The first generating generates a plurality of partial images representing a number of stitches corresponding to a first predetermined number, on the basis of the stitch data acquired by the first acquiring, after the first displaying of the pattern image on the display portion. The second displaying displays, each time each of the plurality of partial images is generated by the first generating, the generated partial image on a portion of the pattern image displayed by the first displaying that corresponds to the generated partial image.

Another aspect of the present disclosure provides a non-transitory computer-readable medium storing computer-readable instructions that are executed by a processor provided in a sewing machine. The sewing machine comprises a sewing portion, a first storage portion, and a display portion. The sewing portion sews an embroidery pattern on a cloth, on the basis of stitch data specifying a position of each of a plurality of stitches representing the embroidery pattern. The first storage portion stores the stitch data and pattern data. The pattern data is data of a pattern image that represents the embroidery pattern corresponding to the stitch data. The display portion displays the pattern image. The computer-readable instructions, when executed, instructs the processor to perform processes comprising first acquiring, first displaying, first generating, and second displaying. The first acquiring acquires the stitch data and the pattern data from the first storage portion. The first displaying displays the pattern image on the display portion on the basis of the pattern data acquired by the first acquiring. The first generating generates a plurality of partial images representing a number of stitches corresponding to a first predetermined number, on the basis of the stitch data acquired by the first acquiring, after the first displaying of the pattern image on the display portion. The second displaying displays, each time each of the plurality of partial images is generated by the first generating, the generated partial image on a portion of the pattern image displayed by the first displaying that corresponds to the generated partial image.

BRIEF DESCRIPTION OF THE DRAWINGS

Embodiments of the disclosure will be described below in detail with reference to the accompanying drawings in which.

DETAILED DESCRIPTION OF EMBODIMENTS

Physical Configuration of Sewing Machine 1

Figure 1:
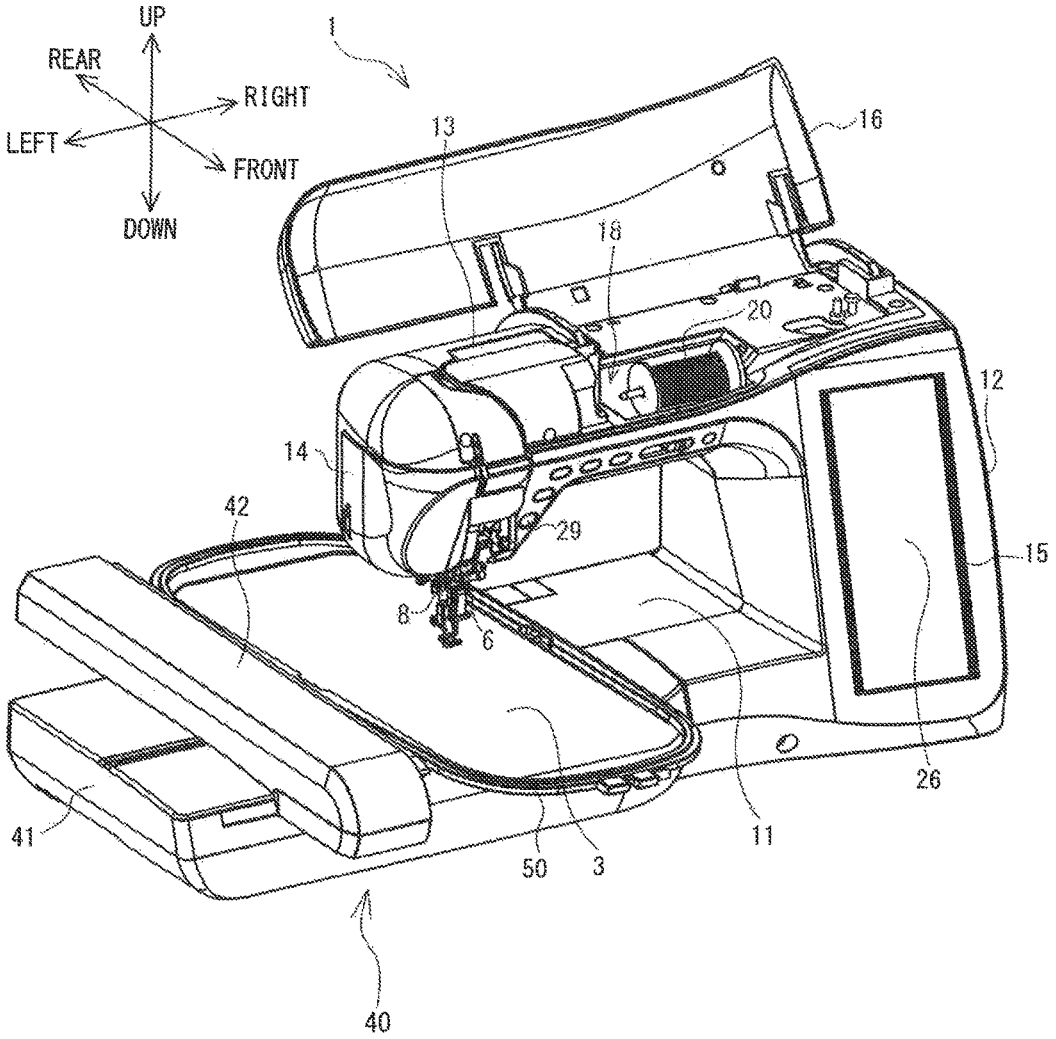
FIG. 1 is a perspective view of a sewing machine.

Below, an embodiment of the present disclosure will be explained with reference to the drawings. Note that the drawings are used to illustrate technological features that can be adopted by the present disclosure, and are not intended to limit the content of the present disclosure. A physical configuration of the sewing machine 1 will be explained with reference to FIG. 1. An up-down direction, a lower right side, an upper left side, a lower left side, and an upper right side of FIG. 1 respectively denote the up-down direction, the front, the rear, the left and the right of a sewing machine 1. A surface on which a display 15 to be described later is arranged is a front surface of the sewing machine 1. A lengthwise direction of a bed portion 11 and an arm portion 13 is the left-right direction of the sewing machine 1 and a side on which a pillar 12 is disposed is the right side. An extending direction of the pillar 12 is the up-down direction of the sewing machine 1.

The sewing machine 1 is provided with the bed portion 11, the pillar 12, the arm portion 13, a head portion 14, and a movement mechanism 40. The bed portion 11 is a base portion of the sewing machine 1, and extends in the left-right direction. The pillar 12 is provided in an upward standing condition from the right end portion of the bed portion 11. The arm portion 13 extends to the left from the upper end of the pillar 12, facing the bed portion 11. The head portion 14 is a portion that is connected to the left leading end portion of the arm portion 13.

The movement mechanism 40 is provided with a main body portion 41 and a carriage 42. The carriage 42 is provided with a frame holder (not shown in the drawings), a Y-axis movement mechanism (not shown in the drawings), and a Y-axis motor 84 (refer to FIG. 2). A plurality of types of embroidery frame can be selectively mounted on and detached from the frame holder. An embroidery frame 50 is an embroidery frame of a known configuration that holds a sewing workpiece 3 by clamping the sewing workpiece 3 between an inner frame and an outer frame. The Y-axis movement mechanism moves the frame holder in the front-rear direction (a Y-axis direction). As a result of the frame holder being moved in the front-rear direction, the embroidery frame 50 moves the sewing workpiece 3 in the front-rear direction. The Y-axis motor 84 drives the Y-axis movement mechanism. The main body portion 41 is internally provided with an X-axis movement mechanism (not shown in the drawings), and an X-axis motor 83 (refer to FIG. 2). The X-axis movement mechanism moves the carriage 42 in the left-right direction (an X-axis direction). As a result of the carriage 42 being moved in the left-right direction, the embroidery frame 50 moves the sewing workpiece 3 in the left-right direction. The X-axis motor 83 drives the X-axis movement mechanism.

The display 15 is provided on the front surface of the pillar 12. A touch panel 26, which can detect a position that is depressed, is provided on the front surface side of the display 15. A user uses a finger or a stylus pen (not shown in the drawings) to perform a touch operation on the touch panel 26, and the touched position is detected by the touch panel 26. Via the touch panel 26, the user can select an embroidery pattern that the user wishes to sew, and select a command to be executed or the like. The pillar 12 is internally provided with a sewing machine motor 81 (refer to FIG. 2).

A cover 16 that can be opened and closed is provided on the upper portion of the arm portion 13. In FIG. 1, the cover 16 is in an open state. A thread storage portion 18 is provided inside the arm portion 13. The thread storage portion 18 can house a thread spool 20, on which an upper thread is wound. A drive shaft (not shown in the drawings), which extends in the left-right direction, is provided inside the arm portion 13. The drive shaft is rotationally driven by the sewing machine motor 81. A switch 29 is provided on a lower left portion of the front surface of the arm portion 13. The switch 29 receives a command to start or to stop the sewing.

The head portion 14 is provided with a needle bar 6, a presser bar 8, a needle bar up-and-down movement mechanism (not shown in the drawings) and the like. The needle bar 6 and the presser bar 8 extend downward from the lower end portion of the head portion 14. A sewing needle (not shown in the drawings) is removably mounted on the lower end of the needle bar 6. The needle bar up-and-down movement mechanism drives the needle bar 6 in the up-down direction as a result of the rotation of the drive shaft.

Electrical Configuration of Sewing Machine 1

Figure 2:
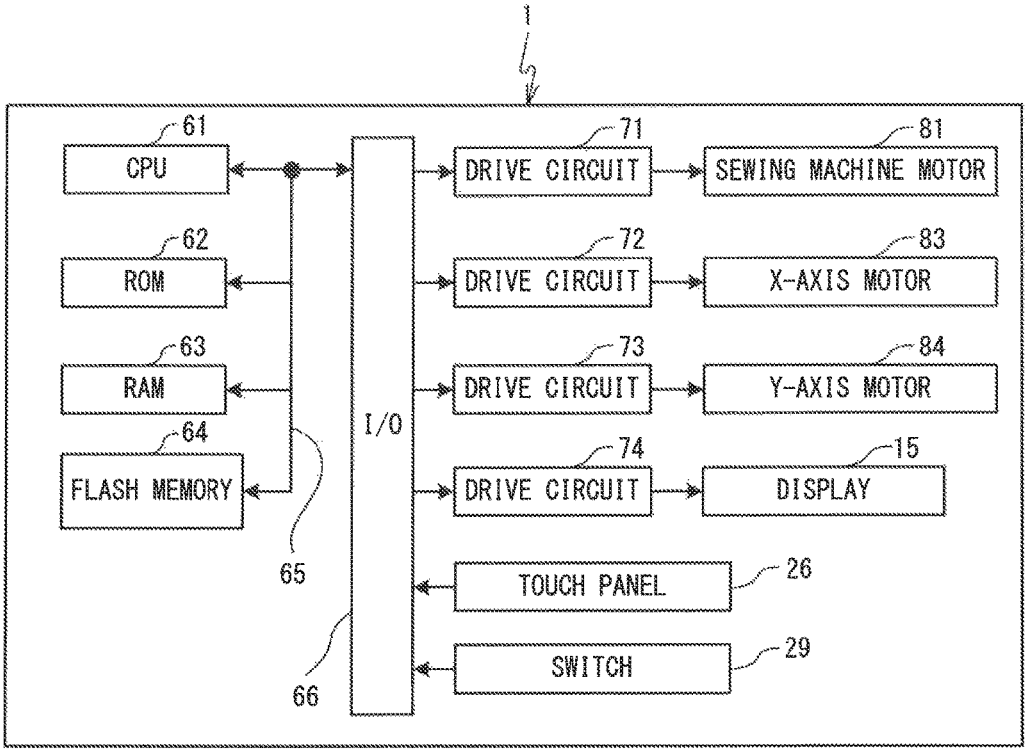
FIG. 2 is a block diagram showing an electrical configuration of the sewing machine.

The electrical configuration of the sewing machine 1 will be explained with reference to FIG. 2. The sewing machine 1 is provided with a CPU 61, and with a ROM 62, a RAM 63, a flash memory 64, and an input/output interface (I/O) 66, which are each connected to the CPU 61 by a bus 65.

The CPU 61 performs overall control of the sewing machine 1, and executes various arithmetic calculations and processing relating to the sewing, in accordance with various programs stored in the ROM 62. The ROM 62 stores the various programs used to operate the sewing machine 1. The RAM 63 is provided with storage areas as necessary, in order to store calculation results etc. of arithmetic calculation processing by the CPU 61. Specifically, the RAM 63 is provided with a file table area 631 (refer to FIG. 4), which will be described later. The RAM 63 is provided with a display buffer. The CPU 61 displays images on the display 15 on the basis of data of images stored in the display buffer. The flash memory 64 stores a first predetermined number, a second predetermined number, and a third predetermined number (to be described later), as various parameters used by the sewing machine 1 to execute the various processing. Set values of the first predetermined number, the second predetermined number, and the third predetermined number are, respectively, "10000," "9," and "10000." The flash memory 64 stores data of folder images, a first standard image, and a second standard image (to be described later). The flash memory 64 stores data of bounding rectangles, which are minimum rectangular shapes surrounding each of the first standard image and the second standard image. Embroidery data, which will be described later, is stored in the flash memory 64. The embroidery data is stored in one of a plurality of folders having a hierarchy structure. The embroidery data will be described in more detail later. The I/O 66 is connected to drive circuits 71 to 74, the touch panel 26, and the switch 29.

Note that the flash memory 64 may store the programs to operate the sewing machine 1. In this case, the programs may be rewritable from outside. For example, the programs may be read out from a storage medium by a drive device (not shown in the drawings) provided in the sewing machine 1, and the flash memory 64 may store the programs.

The drive circuit 71 is connected to the sewing machine motor 81. The drive circuit 71 drives the sewing machine motor 81 in accordance with a control signal from the CPU 61. The needle bar up-and-down movement mechanism (not shown in the drawings) is driven via the drive shaft (not shown in the drawings) of the sewing machine 1 in accordance with the driving of the sewing machine motor 81, and the needle bar 6 thus moves up and down. The drive circuit 72 is connected to the X-axis motor 83. The drive circuit 73 is connected to the Y-axis motor 84. The drive circuits 72 and 73 drive the X-axis motor 83 and the Y-axis motor 84, respectively, in accordance with a control signal from the CPU 61. The embroidery frame 50 is moved in the left-right direction (the X-axis direction) and in the front-rear direction (the Y-axis direction) in accordance with the driving of the X-axis motor 83 and the Y-axis motor 84, by a movement amount that corresponds to the control signal. The drive circuit 74 causes an image to be displayed on the display 15 by driving the display 15 in accordance with a control signal from the CPU 61.

Embroidery Data

The embroidery data includes at least stitch data. The stitch data is data used by the sewing machine 1 to perform the sewing of the embroidery pattern. The stitch data identifies respective positions of a plurality of stitches representing the embroidery pattern. Specifically, the stitch data includes a sewing order, coordinate data, and thread color information. The coordinate data uses relative coordinates to represent positions, of an embroidery coordinate system, of needle drop points used to sew the embroidery pattern. The relative coordinates are shown by a difference between respective coordinates of two continuous needle drop points. In other words, the coordinate data shows a movement amount in the X-axis direction and the Y-axis direction, respectively, when the embroidery frame 50 is moved in order to form a single stitch. The thread color information is information showing a color of the upper thread used in the sewing of the embroidery pattern. The CPU 61 sews the embroidery pattern on the sewing workpiece 3 by moving the embroidery frame 50 in the X-axis direction and the Y-axis direction and driving the needle bar 6 on the basis of the stitch data.

The embroidery data sometimes further includes pattern data that is associated with the stitch data. The pattern data is data used to generate an image (hereinafter also referred to as a "pattern image") showing the embroidery pattern sewn on the basis of the corresponding stitch data. More specifically, the pattern data includes block data respectively representing a plurality of block images forming the pattern image. The format of the block data includes the BMP format, the JPEG format and the like. In other words, the pattern image is generated by combining the plurality of block images represented by the plurality of block data.

There is a case in which at least one of the embroidery data and the stitch data is encoded. When the embroidery data is encoded, the CPU 61 can refer to the stitch data and the embroidery data by decoding the embroidery data using predetermined first key information. Further, when the stitch data is encoded, the CPU 61 can refer to data included in the stitch data by using predetermined second key information to decode the stitch data. In addition, there is a case in which at least one of the stitch data and the block data included in the embroidery data is damaged. When the stitch data is damaged, the CPU 61 cannot perform the sewing of the embroidery pattern on the basis of that stitch data. When the block data is damaged, the CPU 61 cannot generate the pattern image on the basis of the pattern data including that block data.

Selection Screen 151

A selection screen 151 (selection screens 151A and 151B) that is displayed on the display 15 (refer to FIG. 1) will be explained with reference to FIG. 3. The selection screen 151 is a screen that prompts a user to select the pattern image to be sewn by the sewing machine 1. The selection screen 151 includes a folder name 51, a thumbnail image 52, a page switching button 53, and a hierarchy switching button 54.

The selection screen 151A will be explained. The folder name 51 indicates a folder name of one of a plurality of folders stored in the flash memory 64. On the selection screen 151, "bPocket" corresponds to the folder name. Hereinafter, the folder of the folder name indicated by the folder name 51 is referred to as a "target folder."

The thumbnail image 52 shows, in a thumbnail format, an image corresponding to a subfolder stored directly below the target folder stored in the flash memory 64, or images corresponding to the embroidery data. The thumbnail image 52 includes nine frames 521. The shape of each of the nine frames 521 is a rectangle. The nine frames 521 correspond, respectively, to nine folders stored directly below the target folder, or to the embroidery data. The nine frames 521 are aligned in threes in both the vertical direction and the horizontal direction. Hereinafter, the horizontal lines of the nine frames 521 are referred to as "rows" and the vertical lines as "columns." Of the nine frames 521, a position of the frame 521 that is an m-th row from the top, and an M-th column from the left is referred to as an "m-th row M-th column position."

The images displayed inside each of the plurality of frames 521 are one of the following four types. The first type is a folder image 52A that is displayed inside the frame 521 in the first row first column position. The folder image 52A corresponds to a folder stored in the target folder. The folder image 52A is a standard image having a folder shape. The folder image 52A is displayed on the basis of data of a folder image stored in the flash memory 64.

The second type is a pattern image 521B, which is displayed inside the six frames 521 in the first row second column position, the first row third column position, the second row first column position, the second row second column position, the second row third column position, and the third row second column position, respectively. Of the embroidery data stored in the target folder, the pattern image 521B is the embroidery data that can be sewn by the sewing machine 1 and corresponds to the embroidery data from which the pattern image can be generated. More specifically, the pattern image 521B is the embroidery data whose stitch data can be analyzed, and corresponds to the embroidery data from which the pattern image can be generated. The embroidery data whose stitch data can be analyzed refers to data to which (1) below applies, and which includes the stitch data to which (2) below applies.

(1) Embroidery data that is not encoded, or that can be decoded even if encoded (2) Stitch data that is not encoded, or that can be decoded even if encoded, and that is not damaged.

Further, the embroidery data from which the pattern image can be generated is (3) embroidery data including the pattern data from which the pattern image can be generated. Thus, when the embroidery data does not include the pattern data, or when the embroidery data includes the pattern data from which the pattern image cannot be generated, this is the embroidery data from which the pattern image cannot be generated. Note that the embroidery data from which the pattern image cannot be generated indicates that at least some of the plurality of block data corresponding to the pattern data are damaged.

The pattern image 521B is a pattern image generated on the basis of the pattern data. Note that, in the present embodiment, a data amount of the pattern data stored in the flash memory 64 is restricted in order to suppress the capacity of the flash memory 64. Thus, the resolution of the pattern image 521B generated on the basis of the pattern data is relatively low, and jaggies are evident.

The third type is a first standard image 521C that is displayed inside the frame 521 in the third row first column position. Of the embroidery data stored in the target folder, the first standard image 521C is the embroidery data that can be sewn by the sewing machine 1, and corresponds to the embroidery data from which the pattern image cannot be generated. More specifically, the first standard image 521C is the embroidery data whose stitch data cannot be analyzed, and that corresponds to the embroidery data including the pattern data from which the pattern image cannot be generated. The first standard image 521C is a standard image indicating an hourglass. The first standard image 521C is displayed on the basis of first standard image data stored in the flash memory 64.

The fourth type is a second standard image 52D that is displayed inside the frame 521 in the third row third column position. Of the embroidery data stored in the target folder, the second standard image 52D corresponds to the embroidery data that cannot be sewn by the sewing machine 1. The second standard image 52D is a standard image showing a face. The second standard image 52D is displayed on the basis of second standard image data stored in the flash memory 64.

The CPU 61 changes the pattern image 521B (refer to the selection screen 151A) displayed as the thumbnail image 52 to a stitch image 522B (refer to the selection screen 151B), and further changes the first standard image 521C (refer to the selection screen 151A) to a stitch image 522C (refer to the selection screen 151B). The stitch images 522B and 522C are different to the pattern image 521B and the first standard image 521C, and are generated on the basis of the stitch data included in the embroidery data. More specifically, the CPU 61 generates the stitch images 522B and 522C by representing each of the plurality of stitches specified by the stitch data as images. Note that in the stitch image 522B, the image is formed in units of stitches, and thus the resolution is higher than the resolution of the pattern image 521B. Thus, the stitch image 522B is smooth and the jaggies are not evident, and the appearance thereof is better than that of the pattern image 521B.

The CPU 61 changes the pattern image 521B to the stitch image 522B a little at a time, in the manner described below. The CPU 61 extracts, from among the plurality of stitches specified by the stitch data, a number of stitches corresponding to the first predetermined number. The CPU 61 generates an image expressing, as an image, each of the extracted number of stitches corresponding to the first predetermined number, namely, generates an image (hereinafter referred to as a partial image) 5211 of a part of the stitch image. The CPU 61 displays the partial image 5211 in place of a part of the pattern image 521B corresponding to the generated partial image 5211. In other words, the CPU 61 replaces the part of the pattern image 521B with the partial image 5211. A pattern image 5211A, in which the part of the pattern image 521B is replaced by the partial image 5211, is displayed in the frame 521.

Next, of the plurality of stitches specified by the stitch data, the CPU 61 further extracts the number of stitches corresponding to the first predetermined number, from the plurality of stitches that have not been extracted when generating the partial image 5211, and generates a partial image 5212. The CPU 61 displays the partial image 5212 in place of a part of the pattern image 5211A corresponding to the generated partial image 5212. A pattern image 5212A, in which the part of the pattern image 521B is replaced by the partial images 5211 and 5212, is displayed in the frame 521.

The above processing is repeated until all of the plurality of stitches specified by the stitch data are extracted, by the number of stitches corresponding to the first predetermined number each time. The whole of the pattern image 521B is replaced by the plurality of partial images 5211, 5212, and 5213 generated by extracting all of the plurality of stitches. The image in which the plurality of partial images 5211, 5212, and 5213 are combined corresponds to the stitch image 522B. In the above-described manner, the stitch image 522B is eventually displayed in place of the pattern image 521B.

Although not explained in detail here, it should be noted that also when the first standard image 521C is changed to the stitch image 522C, similarly to the above-described case, partial images that are images of a part of the stitch image 522C are sequentially generated. The generated partial image is displayed in place of the part of the first standard image 521C. In other words, the part of the first standard image 521C is replaced by the generated partial image. Eventually, the whole of the first standard image 521C is replaced by the stitch image 522C in which the plurality of partial images are combined. In the above-described manner, the stitch image 522C is eventually displayed in place of the first standard image 521C.

There is a case in which an orientation of the partial image and the stitch image generated on the basis of the stitch data does not match an orientation of the pattern image generated on the basis of the pattern data. In the present embodiment, a case is assumed in which the partial image and the stitch image are in a state of being rotated by 90 degrees in the clockwise direction with respect to the pattern image. In this case, if, in place of the part of the pattern image, the partial image is displayed as it is, the pattern image and the partial image become displaced with respect to each other, and the user is unable to recognize the embroidery pattern.

With respect to the above-described case, the CPU 61 performs the following processing. First, the CPU 61 identifies the stitch data from which are generated the partial image and the stitch image rotated by 90 degrees in the clockwise direction with respect to the pattern image. An identification method will be described in detail later. Next, when the partial image 5201 has been generated on the basis of the identified stitch data, the CPU 61 rotates the generated partial image 5201 by 90 degrees in the counterclockwise direction. The CPU 61 displays the partial image 5201 that has been rotated by 90 degrees in the counterclockwise direction in place of the part of the pattern image 521B corresponding to the partial image 5201. Thus, the pattern image 5201A is displayed in which the part of the pattern image 521B has been replaced by the rotated partial image 5201. Through the above-described processing, the CPU 61 aligns the orientation of the partial image and the stitch image and the orientation of the pattern image in this manner.

On the selection screen 151, a maximum number of the frames 521 included in the thumbnail image 52 is "9," which is set as the second predetermined number. When the number of folders or the number of pieces of embroidery data stored directly under the target folder is equal to or less than the second predetermined number, the same number of frames 521 as the number of folders or pieces of embroidery data are included in the thumbnail image 52 such that the frames 521 are arranged in order of the first row first column, the first row second column, the first row third column, the second row first column and so on.

On the other hand, when the number of folders or the number of pieces of embroidery data stored directly under the target folder is greater than the second predetermined number, the folders or the pieces of embroidery data are divided into groups each of a maximum number of the second predetermined number. Then, images corresponding to the folders or the pieces of embroidery data included in each of the divided plurality of groups are displayed on the single selection screen 151. Further, in order to display the images corresponding to the folders or the pieces of embroidery data included in each of the plurality of groups, a plurality of the selection screens 151 corresponding to each of the plurality of groups are switched and displayed one screen at a time on the display 15. Hereinafter, each of an n (n=1, 2, . . . ) number of the selection screens 151 corresponding to an n number of the groups is referred to as an "n-th page selection screen 151."

The page switching button 53 is a button used to switch between the pages of the selection screen 151. As described above, when the number of folders or the number of pieces of embroidery data stored directly under the target folder is greater than the second predetermined number, the user can switch between the pages of the selection screen 151 by selecting the page switching button 53. By the above-described processing, the user can verify all of the images corresponding to each of the folders or the pieces of embroidery data that are greater than the second predetermined number stored in the target folder, while switching the pages of the selection screen 151. Hereinafter, the page of the selection screen 151 displayed on the display 15 is referred to as a "target page."

The hierarchy switching button 54 is a button used to switch the target folder to another folder. For example, when the hierarchy switching button 54 of the selection screen 151 is selected, the target folder is switched from the folder of the folder name "bPocket" to a folder one level above. Note that when the folder image 52A of the thumbnail image 52 is selected also, the target folder is switched in the same manner. In this case, the target folder is switched from the folder of the folder name "bPocket" to a folder corresponding to the folder image 52A.

The user performs an operation to select the embroidery pattern to be a sewing target in the following manner, via the selection screen 151. The user selects the hierarchy switching button 54 or the folder image 52A of the thumbnail image 52 and thus switches the target folder, then selects the page switching button 53 and switches the target page. Thus, the user causes the page of the selection screen 151 that includes the pattern image 521B representing the embroidery pattern of the sewing object, the pattern images 5211A and 5212A that replace the partial images 5211 and 5212 of the parts of the pattern image 521B, and one of the stitch images 522B as the thumbnail image 52, to be displayed on the display 15.

In the above-described state, the user performs an operation to select the frame 521 includes the image corresponding to the embroidery pattern of the sewing object. The CPU 61 identifies the embroidery data corresponding to the image included in the selected frame 521, and further identifies the stitch data included in the identified embroidery data. On the basis of the identified stitch data, the CPU 61 moves the embroidery frame 50 in the left-right direction (the X-axis direction) and the front-rear direction (the Y-axis direction) using the movement mechanism 40. At the same time, the CPU 61 drives the needle bar up-and-down movement mechanism (not shown in the drawings). By this processing, the embroidery pattern corresponding to the image selected via the selection screen 151 is sewn on the sewing workpiece 3 held by the embroidery frame 50.

File Table 60

A file table 60 stored in a file table area 631 of the RAM 63 will be explained with reference to FIG. 4. The file table 60 is used to display the selection screen 151 including the image corresponding to the folder or the embroidery data, as the thumbnail image 52. The file table 60 is created for each of the folders stored in the flash memory 64. The file table 60 includes a first file table 60A and a second file table 60B.

In the first file table 60A, an index of the subfolder or the embroidery data stored directly under one of the folders is managed per page. In the first file table 60A, the page and the index are associated with each other. The page corresponds to the page of the selection screen 151. The index is sequentially allocated to the folder or the embroidery data. In the case of FIG. 4, "1 to 9," "10 to 18" and "19 and 20" are associated, as indices, with each of the pages "1," "2," and "3."

In the second file table 60B, information relating to the folder or the embroidery data to which the indices of the first file table 60A are allocated is managed. The second file table 60B includes left end coordinates, upper end coordinates, a file/folder ID, a title, and image information per each of the indices. The left end coordinates indicate, using horizontal (X-axis direction) coordinates, a position of the left end of the frame 521 (refer to FIG. 3) displaying the image corresponding to the folder or the embroidery data. The upper end coordinates indicate, using vertical (Y-axis direction) coordinates, a position of the upper end of the frame 521 displaying the image corresponding to the folder or the embroidery data. The file/folder ID is flag information indicating the folder or the embroidery data. The title indicates the folder name of the folder, or a file name of the embroidery data. The image information is information relating to the image displayed in the frame 521.

The image information includes a status flag, a rotation flag, a first horizontal size, a first vertical size, a second horizontal size, a second vertical size, a delete flag, and display image data. The status flag shows one of "0" (no image), "1" (pattern image generation complete), "2" (stitch image being generated), "3" (stitch image generation complete), and "4" (generation failure). The rotation flag will be described in detail later. The first horizontal size indicates a maximum length of the stitch image in the horizontal direction. The first vertical size indicates a maximum length of the stitch image in the vertical direction. The second horizontal size indicates a maximum length of the pattern image in the horizontal direction. The second vertical size indicates a maximum length of the pattern image in the vertical direction. The delete flag is flag information indicating whether the display image data is to be deleted. The display image data represents the data of the image displayed inside the frame 521. As the display image data, one of the following pieces of data is stored: the data of the pattern image 521B (refer to FIG. 3); the data of the pattern images 5211A and 5212A (refer to FIG. 3) that replace the partial images 5211 and 5212 of the parts of the pattern image 521B; and the data of the stitch image 522B (refer to FIG. 3). Hereinafter, the left end coordinates, the upper end coordinates, the file/folder ID, the title, and the image information stored per index are collectively referred to as "file information."

Main Processing

Processing (main processing) performed by the CPU 61 of the sewing machine 1 will be explained with reference to FIG. 5 to FIG. 11. When the CPU 61 detects, via the touch panel 26 (refer to FIG. 1), an input operation to display the selection screen 151 (refer to FIG. 3) on the display 15, the CPU 61 starts the main processing (refer to FIG. 5), by reading out and executing the program stored in the ROM 62. When starting the main processing, the CPU 61 stores a path of a root folder in a target folder path, which is a variable stored in the RAM 63. The CPU 61 stores "1" as a target page number, which is a variable stored in the RAM 63.

Figure 4:
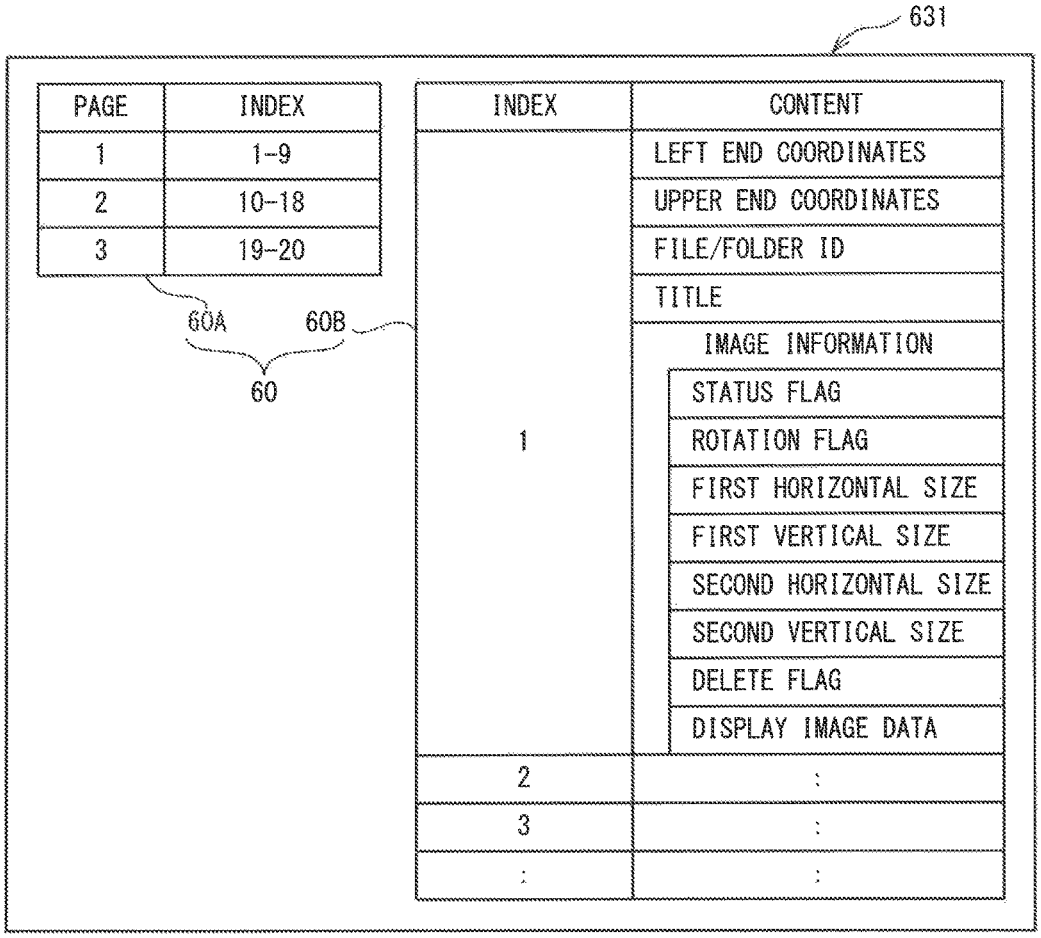
FIG. 4 is a diagram showing a file table.
Figure 5:
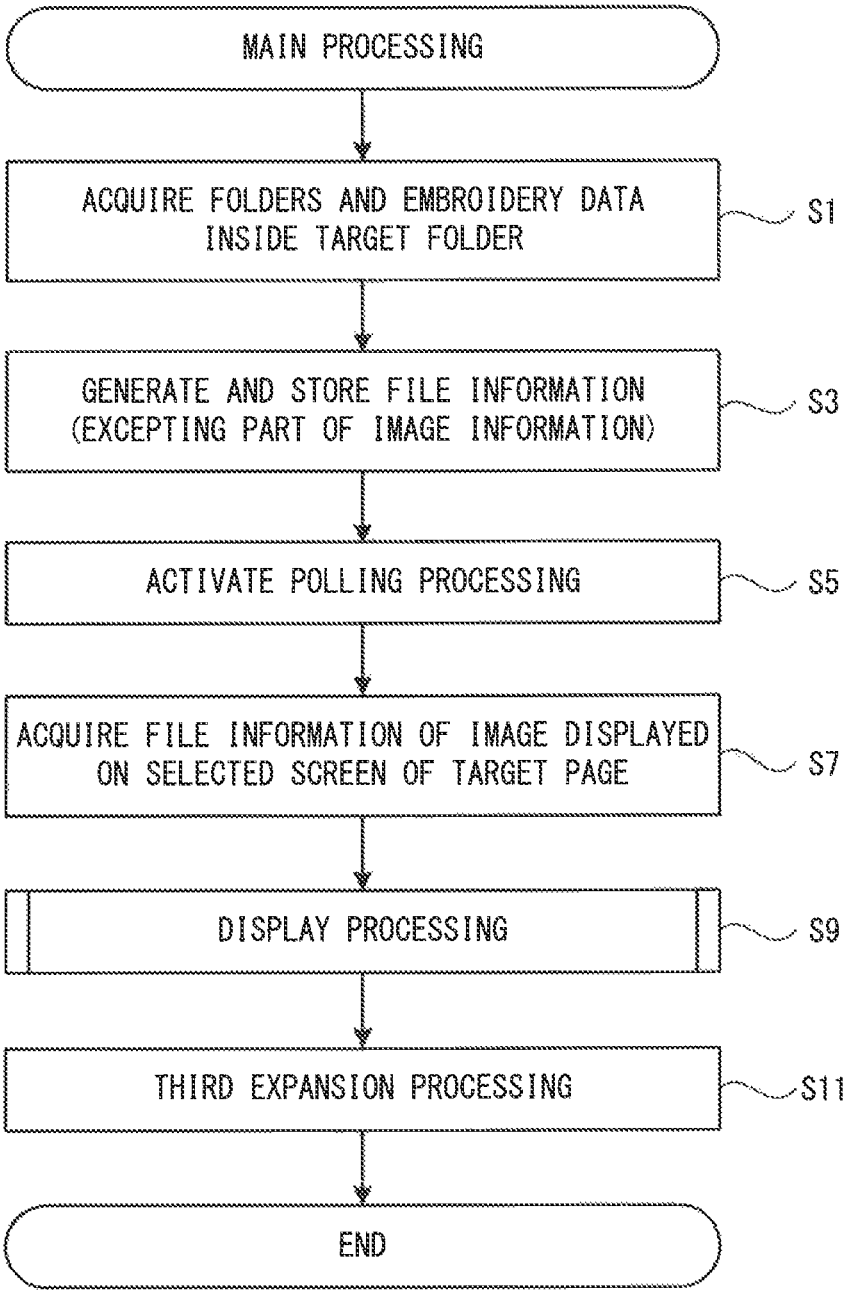
FIG. 5 is a flowchart of main processing.

As shown in FIG. 5, the CPU 61 reads out and acquires all of the folders or all of the embroidery data stored directly below the target folder on the path indicated by the target folder path (step S1). On the basis of the acquired folders or embroidery data, the CPU 61 generates the first file table 60A and the second file table 60B (refer to FIG. 4) (step S3). The CPU 61 stores the generated first file table 60A and second file table 60B in the file table area 631 (refer to FIG. 4) of the RAM 63 (step S3).

Details of the method of generating the first file table 60A are as follows. The method of generating the first file table 60A will be specifically explained with reference to FIG. 4. It is assumed that a total number of the folders or the pieces of embroidery data stored directly under the target folder is "20." The CPU 61 sequentially allocates the indices "1, 2, . . . , 20" to each of the acquired folders or pieces of embroidery data. The CPU 61 calculates a number of groups as "3," when the total number "20" of the folders or the pieces of embroidery data is divided into groups of "9," which is set as the second predetermined number. The CPU 61 stores, as the pages of the first file table 60A, the page numbers "1, 2, 3" of each of the groups. The CPU 61 associates "1 to 9" with the page "1" as the indices, associates "10 to 18" with the page "2" as the indices, and associates "19 and 20" with the page "3" as the indices.

Details of the method of generating the second file table 60B are as follows. The CPU 61 stores, as the left end coordinates and the upper end coordinates corresponding to the indices "1," "10," and "19," the X coordinates and the Y coordinates of an upper left corner of the frame 521 in the first row first column position of the thumbnail image 52 (refer to FIG. 3). Hereinafter, by the same procedure, the X coordinates and the Y coordinates of the upper left corners of the frames 521 in the respective positions of first row second column, first row third column, second row first column, second row second column, second row third column, third row first column, third row second column, and third row third column are stored as the left end coordinates and the upper end coordinates corresponding to each of the indices "2," "11," and "20," the indices "3" and "12," the indices "4" and "13," the indices "5" and "14," the indices "6" and "15," the indices "7" and "16," the indices "8" and "17," and the indices "9" and "18." The CPU 61 stores the flag information indicating the folder or the embroidery data as the file/folder ID.

Figure 3:
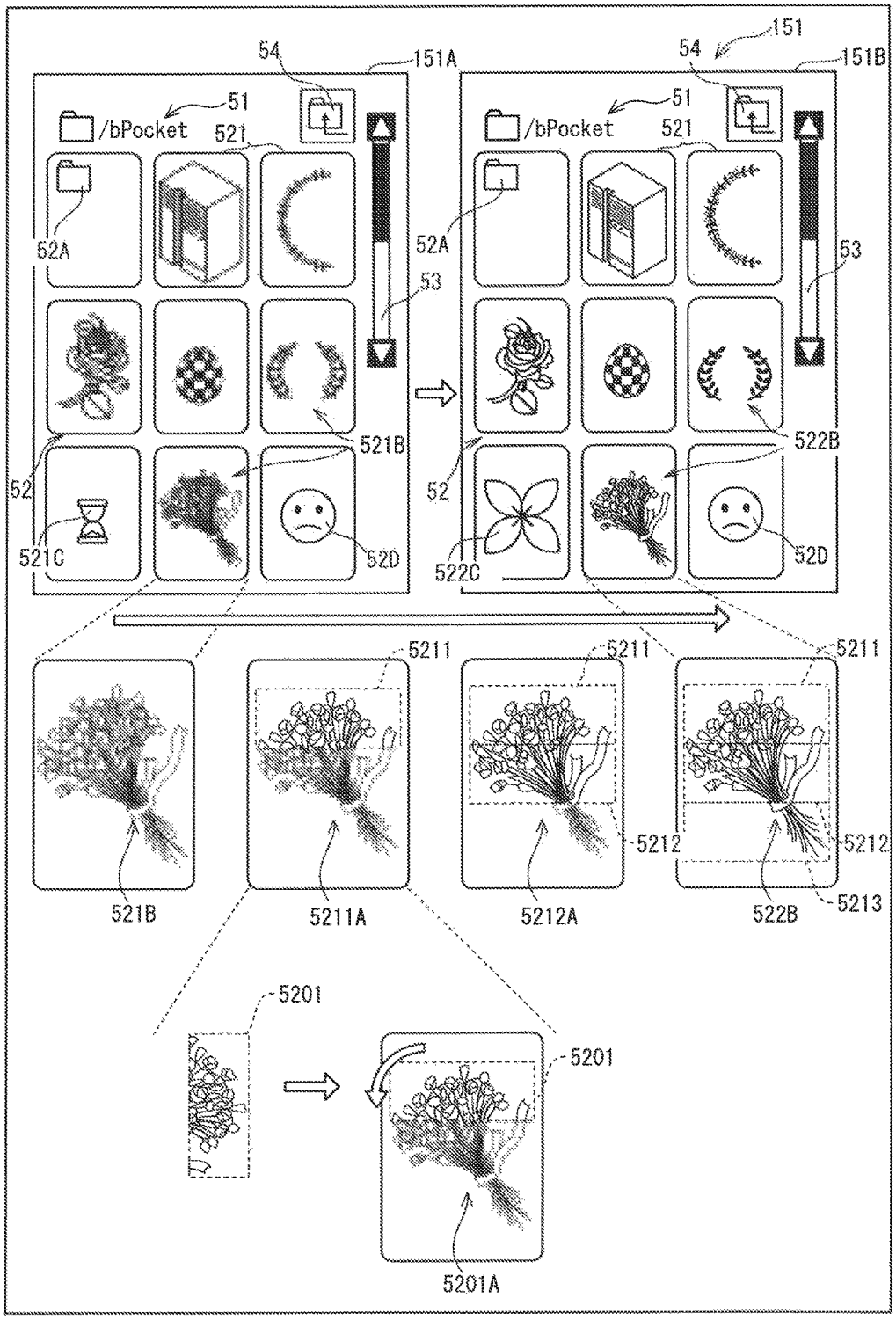
FIG. 3 is a diagram showing a selection screen.

When the flag information indicating the folder is stored as the file/folder ID, the CPU 61 reads out, from the flash memory 64, the data of the folder image 52A (refer to FIG. 3). The CPU 61 stores the data of the read out folder image as the display image data. The CPU 61 stores the folder name of the folder as the title. The CPU 61 stores "1" (pattern image generation complete) in the status flag. Note that the rotation flag, the first horizontal size, the first vertical size, the second horizontal size, the second vertical size, and the delete flag are not stored.

On the other hand, when the flag information indicating the embroidery data is stored as the file/folder ID, the CPU 61 stores the file name of the embroidery data as the title. The CPU 61 stores "0" (no image) in the status flag. Note that the rotation flag, the first horizontal size, the first vertical size, the second horizontal size, the second vertical size, the delete flag, and the display image data are not stored.

As shown in FIG. 5, after ending the processing at step S3, the CPU 61 activates polling processing (refer to FIG. 11) (step S5). In the polling processing, processing is performed in accordance with which of the folder image 52A, the page switching button 53, and the hierarchy switching button 54 (refer to FIG. 3) has been selected, on the thumbnail image 52 of the selection screen 151. The polling processing is performed in parallel with the main processing. The polling processing will be described in detail later.

After activating the polling processing, the CPU 61 identifies, in the first file table 60A (refer to FIG. 4), the index corresponding to the page of the number indicated by the target page number. Note that, when the main processing is activated, "1" is stored as the target page number. When the target page number is "1" in the second file table 60B (refer to FIG. 4), the corresponding indices "1 to 9" are identified. Note that the target page number is updated in the polling processing (refer to FIG. 11) when it is determined which of the folder image 52A, the page switching button 53, and the hierarchy switching button 54 is selected. When the updated target page number is "2" in the second file table 60B, the corresponding indices "10 to 18" are identified, and when the updated target page number is "3" in the second file table 60B, the corresponding indices "19 and 20" are identified. The CPU 61 acquires the file information corresponding to the identified indices, from among the second file table 60B (step S7). The acquired file information corresponds to the image displayed as the thumbnail image 52 of the selection screen 151. The CPU 61 performs display processing (refer to FIG. 6) (step S9).

The display processing will be explained with reference to FIG. 6. The CPU 61 selects one of the file information selected by the processing at step S7 (refer to FIG. 5), in the order of the corresponding indices (step S31). Hereinafter, the file information selected by the processing at step S31 is referred to as "selected file information." The CPU 61 determines whether a value equal to or greater than "1" is stored as the status flag of the selected file information (step S33). When "1" (pattern image generation complete) is stored as the status flag, the data of the folder image 52A (refer to FIG. 3), the pattern image 521B (refer to FIG. 3), and the first standard image 521C (refer to FIG. 3) are stored as the display image data of the selected file information (step S3 (refer to FIG. 5), and steps S67, S71, S73, and S77 (refer to FIG. 7)). When "2" (stitch image being generated) is stored as the status flag, the data of the pattern images 5211A and 5212A (refer to FIG. 3) that replace the partial images 5211 and 5212 of the parts of the pattern image 521B are stored as the display image data of the selected file information (step S91 (refer to FIG. 8), and step S155 (refer to FIG. 10)). When "3" (stitch image generation complete) is stored as the status flag, the data of the stitch images 522B and 522C (refer to FIG. 3) are stored as the display image data of the selected file information (step S155 (refer to FIG. 10), and step S99 (refer to FIG. 8)). When "4" (generation failure) is stored as the status flag, the data of the second standard image 52D (refer to FIG. 3) is stored as the display image data of the selected file information (steps S79 and S83 (refer to FIG. 7), and steps S161 and S165 (refer to FIG. 10)). In these cases, there is no need to newly generate the pattern image. When the CPU 61 determines that the value equal to or greater than "1" is stored as the status flag (yes at step S33), the CPU 61 advances the processing to step S37.

On the other hand, when "0" is stored as the status flag of the selected file information, the display image data of the selected file information is not stored. In this case, it is necessary to store the data of the image to be displayed as the thumbnail image 52 of the selection screen 151 in the display image data of the selected file information. When the CPU 61 determines that the value equal to or greater than "1" is not stored as the status flag (no at step S33), the CPU 61 performs first expansion processing (refer to FIG. 7) (step S35). After ending the first expansion processing, the CPU 61 advances the processing to step S37.

Figure 7:
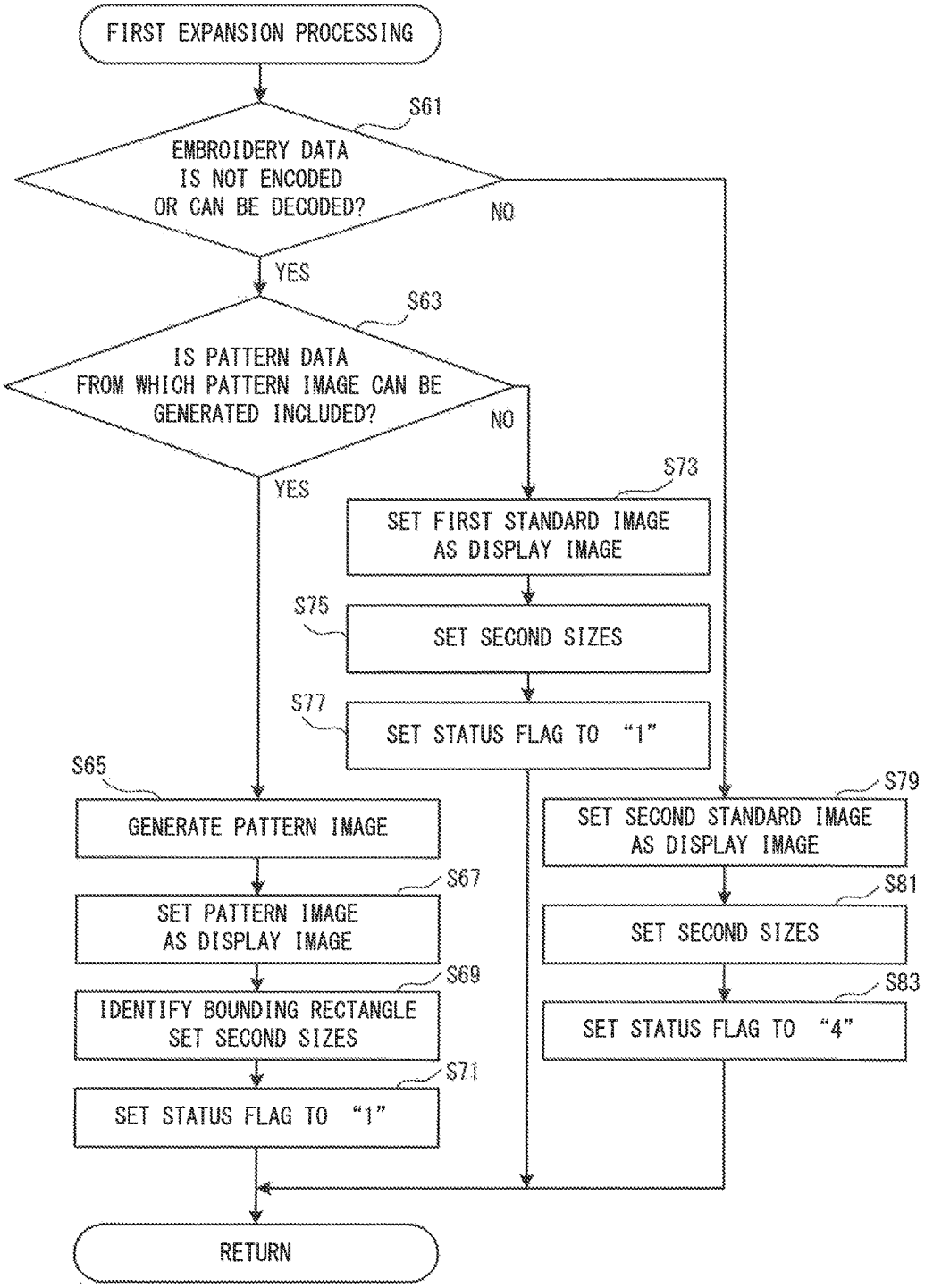
FIG. 7 is a flowchart of first expansion processing.

The first expansion processing will be explained with reference to FIG. 7. The CPU 61 determines whether the embroidery data of the file name identified by the title of the selected file information is the embroidery data corresponding to the above-described (1), namely, is the embroidery data that is not encoded or is the embroidery data that can be decoded even if it is encoded (step S61). When the CPU 61 determines that the embroidery data of the file name identified by the title of the selected file information is not encoded or can be decoded even if it is encoded (yes at step S61), the CPU 61 advances the processing to step S63. The CPU 61 determines whether the embroidery data of the file name identified by the title of the selected file information is the embroidery data from which the pattern image can be generated, namely, determines whether it is the embroidery data that includes the pattern data from which the pattern image can be generated (step S63). When the CPU 61 determines that the embroidery data of the file name identified by the title of the selected file information is the embroidery data including the pattern data from which the pattern image can be generated (yes at step S63), the CPU 61 advances the processing to step S65.

The CPU 61 generates the pattern image on the basis of the pattern data included in the embroidery data (step S65). Specifically, the CPU 61 generates the embroidery pattern by combining the plurality of block images represented by each of the block data. The CPU 61 stores the data of the generated pattern image as the display image data of the selected file information (step S67). The CPU 61 specifies a bounding rectangle of the generated pattern image (step S69). The CPU 61 stores the length in the horizontal direction of the specified bounding rectangle as the second horizontal size of the selected file information. The CPU 61 stores the length in the vertical direction of the specified bounding rectangle as the second vertical size of the selected file information (step S69). The CPU 61 stores "1" as the status flag of the selected file information (step S71). The CPU 61 ends the first expansion processing and returns the processing to the display processing (refer to FIG. 6).

When, in the processing at step S63, the CPU 61 determines that the embroidery data of the file name identified by the title of the selected file information is the embroidery data from which the pattern image cannot be generated, namely, is the embroidery data that does not contain the pattern data, or is the embroidery data including the pattern data from which the pattern image cannot be generated (no at step S63), the CPU 61 advances the processing to step S73. The CPU 61 reads out the data of the first standard image from the flash memory 64. The CPU 61 stores the read out data of the first standard image as the display image data of the selected file information (step S73). The CPU 61 reads out data of the bounding rectangle of the first standard image from the flash memory 64. On the basis of the read out data of the bounding rectangle, the CPU 61 identifies the length in the horizontal direction of the bounding rectangle, and stores the identified length as the second horizontal size of the selected file information. On the basis of the read out data of the bounding rectangle, the CPU 61 identifies the length in the vertical direction of the bounding rectangle, and stores the identified length as the second vertical size of the selected file information (step S75). The CPU 61 stores "1" as the status flag of the selected file information (step S77). The CPU 61 ends the first expansion processing and returns the processing to the display processing (refer to FIG. 6).

When, in the processing at step S61, the CPU 61 determines that the embroidery data of the file name identified by the title of the selected file information does not correspond to (1), namely, that it is the embroidery data that is encoded and cannot be decoded (no at step S61), the CPU 61 advances the processing to step S79. The CPU 61 reads out the data of the second standard image from the flash memory 64. The CPU 61 stores the read out data of the second standard image as the display image data of the selected file information (step S79). The CPU 61 reads out data of the bounding rectangle of the second standard image from the flash memory 64. On the basis of the read out data of the bounding rectangle, the CPU 61 identifies the length in the horizontal direction of the bounding rectangle, and stores the identified length as the second horizontal size of the selected file information. On the basis of the read out data of the bounding rectangle, the CPU 61 identifies the length in the vertical direction of the bounding rectangle, and stores the identified length as the second vertical size of the selected file information (step S81). The CPU 61 stores "4" as the status flag of the selected file information (step S83). The CPU 61 ends the first expansion processing and returns the processing to the display processing (refer to FIG. 6).

Figure 6:
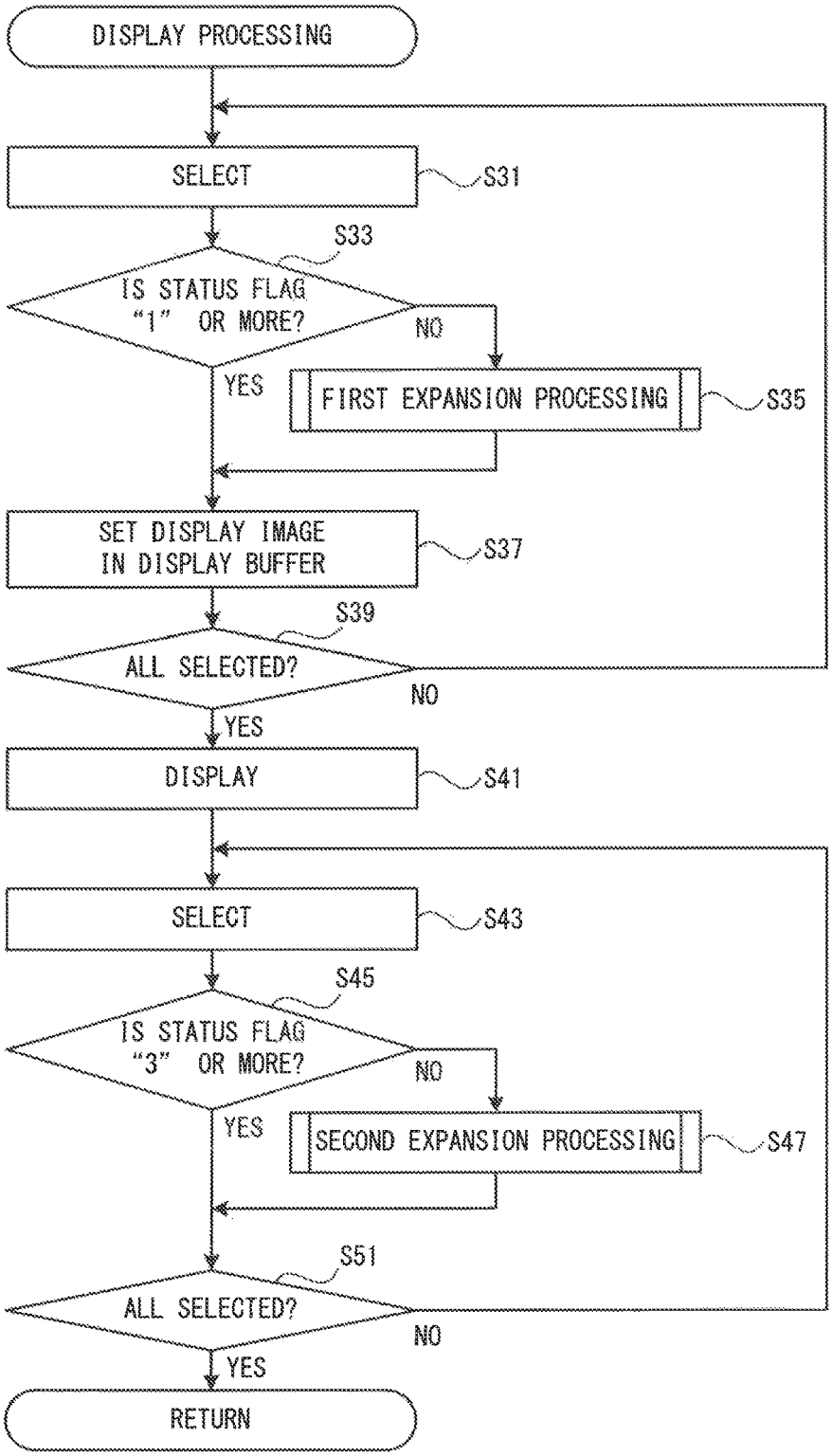
FIG. 6 is a flowchart of display processing.

As shown in FIG. 6, in the processing at step S37, the CPU 61 stores the data of the image, which is stored as the display image data of the selected file information, in the display buffer of the RAM 63 (step S37). Specifically, the CPU 61 calculates the position of the frame 521 identified on the basis of the left end coordinates and the upper end coordinates of the selected file information. On the basis of the data of the image stored as the display image data of the selected file information, the CPU 61 arranges the image inside the calculated frame 521. Note that, when the image is already stored in the display buffer, the image is newly added to the already stored image by the processing at step S37.

The CPU 61 determines whether the file information acquired by the processing at step S7 (refer to FIG. 5) has all been selected by the processing at step S31 (step S39). When the CPU 61 determines that the file information that has not been selected by the processing at step S31 is remaining (no at step S39), the CPU 61 returns the processing to step S31. The CPU 61 selects one of the pieces of file information that has not been selected (step S31) and repeats the processing at steps S33, S35, and S37. Note that, by repeating the processing at step S37, the CPU 61 arranges the image inside each of the plurality of frames 521 that are arranged side by side.

When the CPU 61 determines that all the file information acquired by the processing at step S7 (refer to FIG. 5) has been selected (yes at step S39), the CPU 61 displays the selection screen 151 on the display 15 on the basis of the data of the image stored in the display buffer (step S41). The selection screen 151 includes, as the thumbnail image 52, the image stored in the display buffer by the processing at step S37. The CPU 61 advances the processing to step S43.

The CPU 61 selects, sequentially, one of the pieces of file information selected by the processing at step S7, in order of index (refer to FIG. 5) (step S43). Hereinafter, the file information selected by the processing at step S43 is referred to as the "selected file information," similarly to the file information selected by the processing at step S31. The CPU 61 determines whether a value of "3" or above is stored as the status flag of the selected file information, or whether the flag information indicating the folder is stored as the file/folder ID of the selected file information (step S45). When "3" (stitch image generation complete) is stored as the status flag, the data of the stitch images 522B and 522C is stored as the display image data of the selected file information (step S99, refer to FIG. 8). When "4" (generation failure) is stored as the status flag, the data of the second standard image 52D is stored as the display image data of the selected file information (steps S79 and S83 (refer to FIG. 7), steps S161 and S165 (refer to FIG. 10)). When the flag information indicating the folder is stored as the file/folder ID of the selected file information, the data of the folder image 52A is stored as the display image data of the selected file information (step S3 (refer to FIG. 5)). In these cases, it is not necessary to newly generate the stitch data by repeating the processing to generate the partial image. When the CPU 61 determines that the value of "3" or above is stored as the status flag, or that the flag information indicating the folder is stored as the file/folder ID of the selected file information (yes at step S45), the CPU 61 advances the processing to step S51.

Meanwhile, when the value of "1" (pattern image generation complete) or the value of "2" (stitch image being generated) is stored as the status flag of the selected file information, it is necessary to newly generate the stitch data by repeating the processing to generate the partial image. When the CPU 61 determines that the value of "3" or above is not stored as the status flag (no at step S45), the CPU 61 performs second expansion processing (refer to FIG. 8) (step S47). After ending the second expansion processing, the CPU 61 advance the processing to step S51.

The second expansion processing will be explained with reference to FIG. 8. When the status flag of the selected file information is "1," the CPU 61 stores "2" as the status flag of the selected file information (step S91). The CPU 61 performs calculation processing (refer to FIG. 9) (step S93). The calculation processing will be explained with reference to FIG. 9. The CPU 61 acquires the stitch data included in the embroidery data of the file name identified by the title of the selected file information. The CPU 61 determines whether the acquired stitch data can be analyzed (step S110). Specifically, the CPU 61 determines whether the acquired stitch data is the stitch data that corresponds to the above-described (2), namely, is the stitch data that is not encoded or can be decoded even if it is encoded, and that is not damaged (step S110). When the CPU 61 determines that the acquired stitch data cannot be analyzed (no at step S110), the CPU 61 ends the calculation processing and returns the processing to the second expansion processing (refer to FIG. 8).

When the CPU 61 determines that the acquired stitch data can be analyzed (yes at step S110), the CPU 61 advances the processing to step S111. On the basis of the coordinate data included in the acquired stitch data, the CPU 61 identifies the bounding rectangle that is the minimum rectangle surrounding the stitch image (step S111). The CPU 61 determines whether a direction in which the longer side of the identified bounding rectangle extends (hereinafter referred to as a "stitch lengthwise direction") and the direction of the longer of the second horizontal size and the second vertical size of the selected file information (hereinafter referred to as the "pattern lengthwise direction") are aligned with each other in the horizontal direction or in the vertical direction. When the CPU 61 determines that the stitch lengthwise direction and the pattern lengthwise direction are not aligned with each other, the CPU 61 determines that it is necessary to rotate the partial image generated by partial expansion processing (refer to FIG. 10) (to be described later) by 90 degrees in the counterclockwise direction (yes at step S113). The CPU 61 stores "1" as the rotation flag of the selected file information (step S115). The CPU 61 stores the length in the horizontal direction of the identified bounding rectangle as the first vertical size of the selected file information. The CPU 61 stores the length in the vertical direction of the identified bounding rectangle as the first horizontal size of the selected file information (step S117). The CPU 61 advances the processing to step S123.

On the other hand, when the CPU 61 determines that the stitch lengthwise direction and the pattern lengthwise direction are aligned with each other, the CPU 61 determines that it is not necessary to rotate the partial image generated by the partial expansion processing to be described later (no at step S113). The CPU 61 stores "0" as the rotation flag of the selected file information (step S119). The CPU 61 stores the length in the horizontal direction of the identified bounding rectangle as the first horizontal size of the selected file information. The CPU 61 stores the length in the vertical direction of the identified bounding rectangle as the first vertical size of the selected file information (step S121). The CPU 61 advances the processing to step S123.

The CPU 61 calculates a reduction ratio when causing the first horizontal size and the first vertical size of the selected file information to be the length of the second horizontal size and the second vertical size, respectively (step S123). The formula for calculating the reduction ratio is either "second horizontal size/first horizontal size" or "second vertical size/first vertical size." Note that, in the present embodiment, ratios of each of the length of the horizontal direction and the length of the vertical direction are assumed to match when the orientations of the bounding rectangle of the stitch image and the bounding rectangle of the pattern image are aligned with each other. Thus, calculation results of the above two formulas match each other. The CPU 61 ends the calculation processing and returns the processing to the second expansion processing (refer to FIG. 8).

Figure 8:
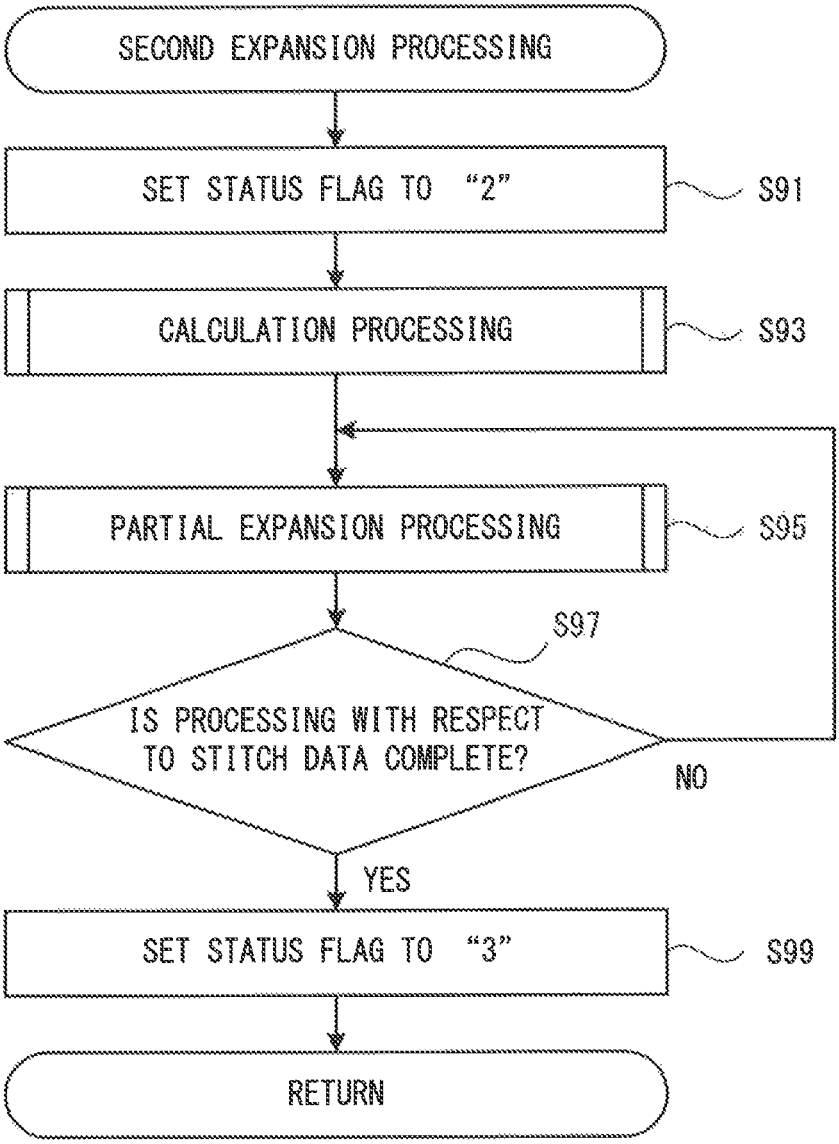
FIG. 8 is a flowchart of second expansion processing.
Figure 9:
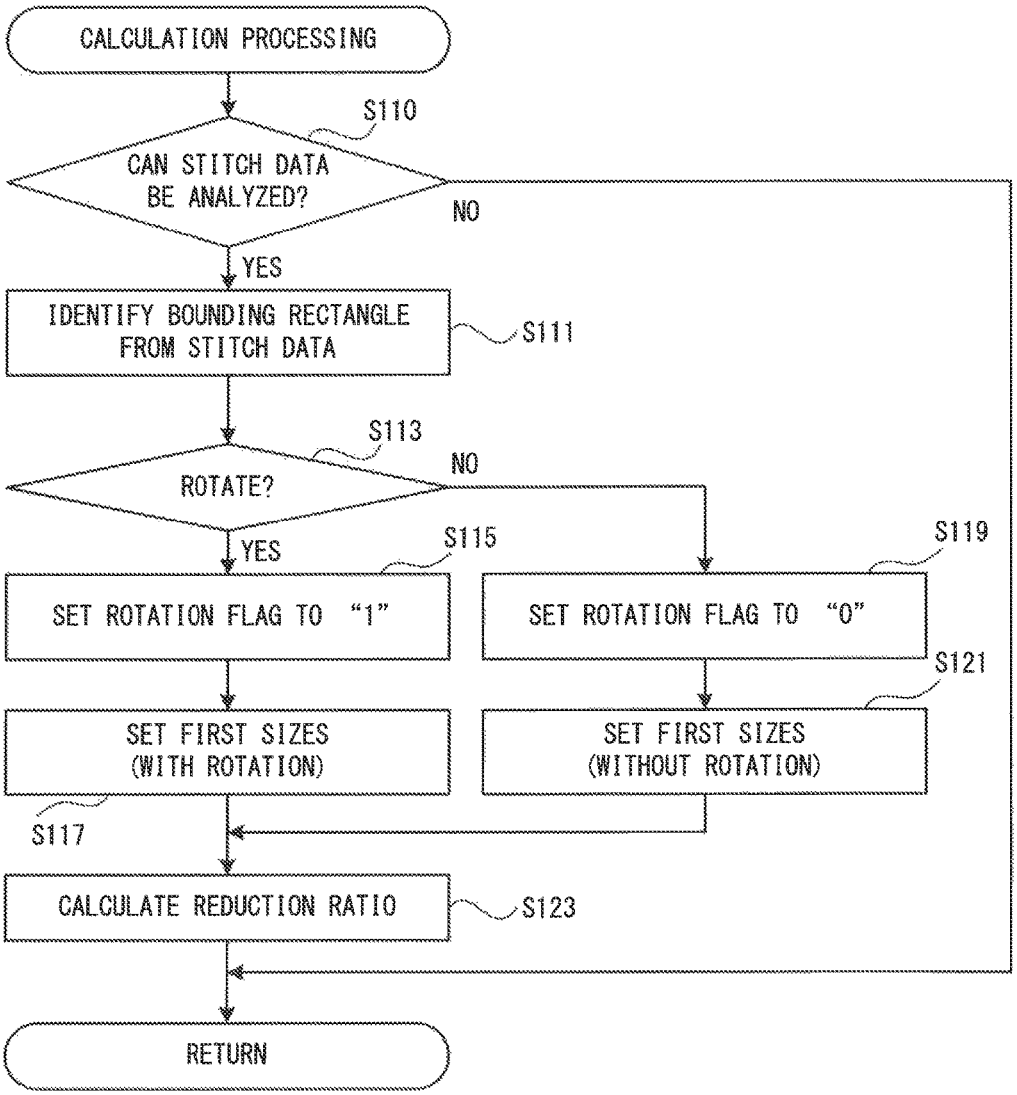
FIG. 9 is a flowchart of calculation processing.

As shown in FIG. 8, after ending the calculation processing (step S93), the CPU 61 performs the partial expansion processing (refer to FIG. 10) (step S95). The partial expansion processing will be explained with reference to FIG. 10. The CPU 61 acquires the stitch data included in the embroidery data of the file name identified by the title of the selected file information (step S131). The CPU 61 determines whether the acquired stitch data is the stitch data corresponding to the above-described (2), namely, the stitch data that is not encoded or that can be decoded even if it is encoded, and that is not damaged (step S133). When the CPU 61 determines that the stitch data does not correspond to the above-described (2), namely, is the stitch data that is encoded and cannot be decoded, or is the stitch data that is damaged (no at step S133), the CPU 61 advances the processing to step S161. The CPU 61 reads out the data of the second standard image from the flash memory 64. The CPU 61 stores the read out data of the second standard image as the display image data of the selected file information (step S161). The CPU 61 reads out the data of the bounding rectangle of the second standard image from the flash memory 64. On the basis of the read out data of the bounding rectangle, the CPU 61 identifies the length in the horizontal direction of the bounding rectangle and stores the identified length as the second horizontal size of the selected file information. On the basis of the read out data of the bounding rectangle, the CPU 61 identifies the length in the vertical direction of the bounding rectangle and stores the identified length as the second vertical size of the selected file information (step S163). The CPU 61 stores "4" as the status flag of the selected file information (step S165). The CPU 61 advances the processing to step S159.

On the other hand, when the CPU 61 determines, in the processing at step S133, that the stitch data is the stitch data that is not encoded, or that can be decoded even if it is encoded, and is the stitch data that is not damaged (yes at step S133), the CPU 61 advances the processing to step S135. The CPU 61 calculates, as a number of stitches, a number of needle drop points specified by the coordinate data included in the acquired stitch data (step S135). The CPU 61 determines whether the calculated number of stitches is less than the third predetermined number (step S137). When the CPU 61 determines that the number of stitches is less than the third predetermined number (yes at step S137), the CPU 61 stores "1" as the delete flag (step S139). The CPU 61 advances the processing to step S143. When the CPU 61 determines that the number of stitches is equal to or greater than the third predetermined number (no at step S137), the CPU 61 stores "0" as the delete flag (step S141). The CPU 61 advances the processing to step S143.

The CPU 61 acquires, in order of the sewing order, one piece of the coordinate data included in the acquired stitch data (step S143). Note that the one piece of coordinate data indicates a movement amount in the X-axis direction and the Y-axis direction, respectively, when the embroidery frame 50 moves in order to form a single stitch. The CPU 61 multiplies each of the X coordinate and the Y coordinate acquired by the processing at step S143 by the reduction ratio calculated by the processing at step S123 (refer to FIG. 9) (step S145). The CPU 61 stores the coordinate data multiplied by the reduction ratio in the RAM 63. Hereinafter, the coordinate data multiplied by the reduction ratio is referred to as "reduced coordinate data."

The CPU 61 determines whether the coordinate data corresponding to the first predetermined number has been acquired by the processing at step S143, or whether all of the coordinate data included in the stitch data has been acquired by the processing at step S143 (step S147). When the CPU 61 determines that the coordinate data corresponding to the first predetermined number has not been acquired, and that all of the coordinate data included in the stitch data has not been acquired (no at step S147), the CPU 61 returns the processing to step S143. The CPU 61 acquires the one piece of coordinate data that is next in the sewing order (step S143) and repeats the processing at step S145.

When the CPU 61 determines, by the processing at step S147, that the coordinate data corresponding to the first predetermined number has been acquired, or determines that all of the coordinate data included in the stitch data has been acquired (yes at step S147), the CPU 61 advances the processing to step S149. The CPU 61 determines whether "0" is stored as the rotation flag in the selected file information (step S149). When the CPU 61 determines that "0" is stored as the rotation flag (yes at step S149), on the basis of the reduced coordinate data stored in the RAM 63, the CPU 61 represents each of the reduced stitches using a line segment of a one dot width. The CPU 61 generates the partial image by combining the plurality of line segments (step S151). The CPU 61 advances the processing to step S155.

When the CPU 61 determines that "1" is stored as the rotation flag of the selected file information (no at step S149), on the basis of the reduced coordinate data stored in the RAM 63, the CPU 61 represents each of the reduced stitches using the line segment of the one dot width. The CPU 61 rotates each of the plurality of line segments by 90 degrees in the counterclockwise direction. The CPU 61 generates the partial image by combining the plurality of rotated line segments (step S153). The CPU 61 advances the processing to step S155.

At step S155, the CPU 61 stores the data of the generated partial image as the display image data of the selected file information. Here, when the image is already stored as the display image data of the selected file information, the generated partial image is stored in place of the part of the already stored image corresponding to the generated partial image. In other words, the part of the already stored image is replaced by the generated partial image. Here, when it is determined by the processing at step S147 that all of the coordinate data included in the stitch data has not been acquired, in the processing at step S155, the data of the pattern image that has been partially replaced by the partial image or the data of the first standard image is stored as the display image data of the selected file information. On the other hand, when it is determined by the processing at step S147 that all of the coordinate data included in the stitch data has been acquired, in the processing at step S155, the data of the pattern image or the data of the stitch image in which all of the first standard image has been replaced by the plurality of partial images is stored as the display image data of the selected file information.

The CPU 61 stores the data of the image stored as the display image data of the selected file information in the display buffer of the RAM 63 (step S157). Specifically, the CPU 61 calculates the position of the frame 521 identified on the basis of the left end coordinates and the upper end coordinates of the selected file information. On the basis of the data of the image stored as the display image data of the selected file information, the CPU 61 arranges the image inside the calculated frame 521. Note that, when the image is already stored in the display buffer, the image is newly added to the already stored image by the processing at step S157.

On the basis of the data of the image stored in the display buffer, the CPU 61 displays the selection screen 151 on the display 15 (step S159). The selection screen 151 includes the image stored in the display buffer by the processing at step S157, as the thumbnail image 52. The CPU 61 ends the partial expansion processing and returns the processing to the second expansion processing (refer to FIG. 8).

Figure 10:
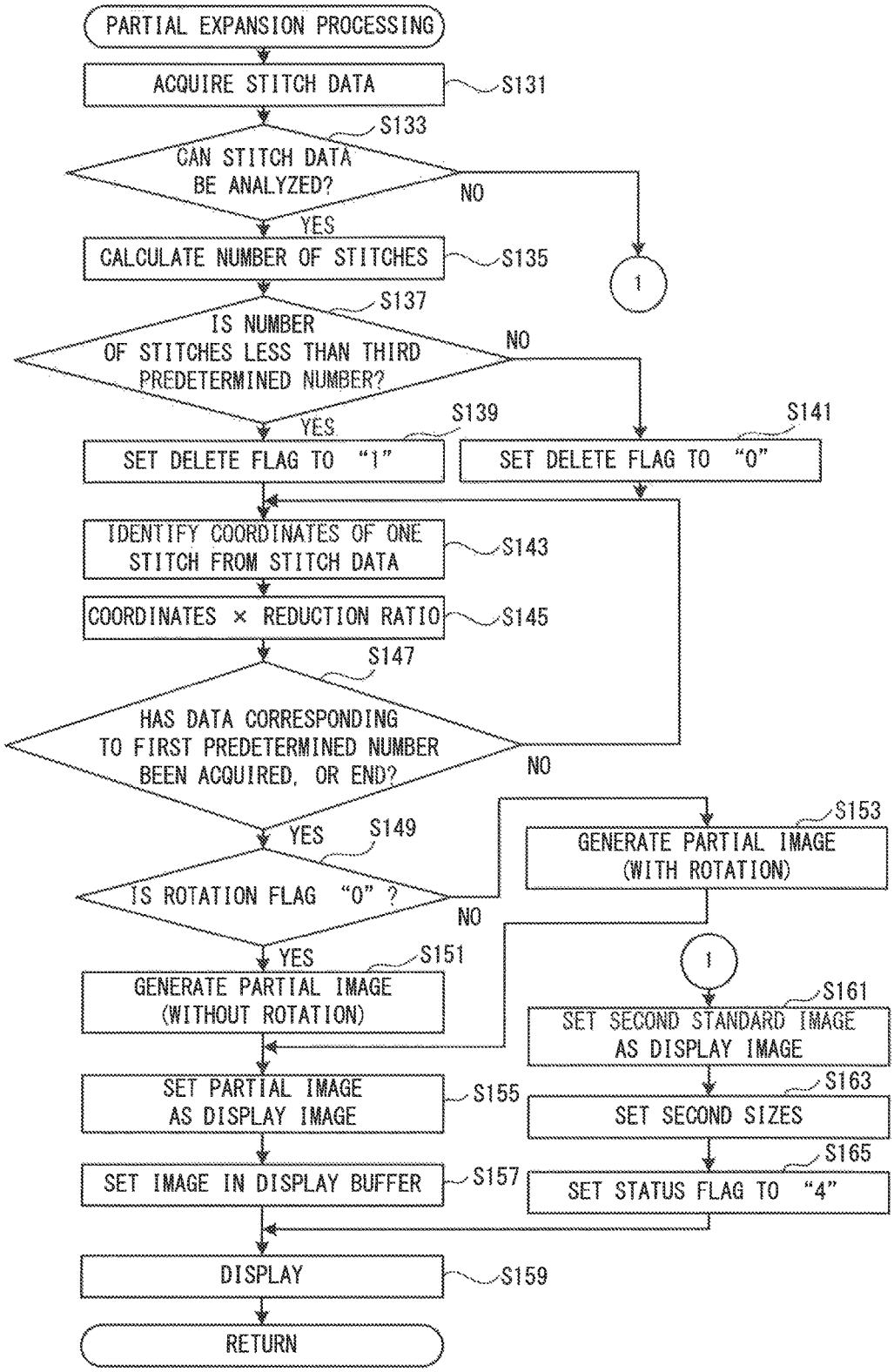
FIG. 10 is a flowchart of partial expansion processing.

As shown in FIG. 8, after ending the partial expansion processing (step S95), the CPU 61 determines whether the processing with respect to the stitch data included in the embroidery data identified by the title of the selected file information is complete (step S97). When the CPU 61 determines that all of the coordinate data included in the stitch data has not been acquired by the processing at step S147 (refer to FIG. 10), the CPU 61 determines that the processing with respect to the stitch data is not complete (no at step S97). In this case, the CPU 61 returns the processing to step S95, and repeats the partial expansion processing (refer to FIG. 10). When the partial expansion processing shown in FIG. 10 is repeated, the CPU 61 acquires, of the coordinate data included in the stitch data, one piece of the coordinate data that has not yet been acquired by the processing at step S143, in the order of the sewing order (step S143). On the basis of the acquired coordinate data, the CPU 61 calculates the reduced coordinate data (step S145).

When, in the processing at step S147, the CPU 61 determines that all of the coordinate data included in the stitch data has been acquired, the CPU 61 determines that the processing with respect to the stitch data is complete (yes at step S97). The CPU 61 stores "3" as the status flag of the selected file information (step S99). The CPU 61 ends the second expansion processing and returns the processing to the display processing (refer to FIG. 6).

As shown in FIG. 6, the CPU 61 determines whether the file information acquired by the processing at step S7 (refer to FIG. 5) has all been selected by the processing at step S43 (step S51). When the CPU 61 determines that the file information that has not been selected by the processing at step S43 is remaining (no at step S51), the CPU 61 returns the processing to step S43. The CPU 61 selects one piece of the file information that has not been selected (step S43) and repeats the processing at steps S45 and S47. When the CPU 61 determines that all of the file information has been selected (yes at step S51), the CPU 61 ends the display processing and returns the processing to the main processing (refer to FIG. 5). As shown in FIG. 5, after ending the display processing (refer to FIG. 6), the CPU 61 performs third expansion processing (step S11).

In the third expansion processing, the image displayed as the thumbnail image 52 on the selection screen 151 of the page other than the target page is generated, before an operation is performed to update the target page to the other page. This is described in detail as follows. Of the pages of the first file table 60A (refer to FIG. 4), the CPU 61 selects one of the pages other than the page displayed by the target page number. The CPU 61 stores the selected page as the target page number. The CPU 61 performs the processing at step S7 (refer to FIG. 5) and the display processing (refer to FIG. 6) on the basis of the stored target page. However, in the display processing performed in the third expansion processing, the CPU 61 does not perform the processing at steps S37 (refer to FIG. 6) and S157 (refer to FIG. 10), and does not store the data of the image in the display buffer. Further, the CPU 61 does not perform the processing at steps S41 (refer to FIG. 6) and S159 (refer to FIG. 10), and does not display the image on the display 15 on the basis of the data of the image stored in the display buffer. Thus, of the folders or the embroidery data stored directly under the target folder, the file information corresponding to the image included as the thumbnail image 52 of the selection screen 151 of the page that is not displayed on the display 15 is generated. When all of the pages of the first file table 60A are stored as the target page, the CPU 61 ends the third expansion processing. The CPU 61 ends the main processing.

Figure 11:
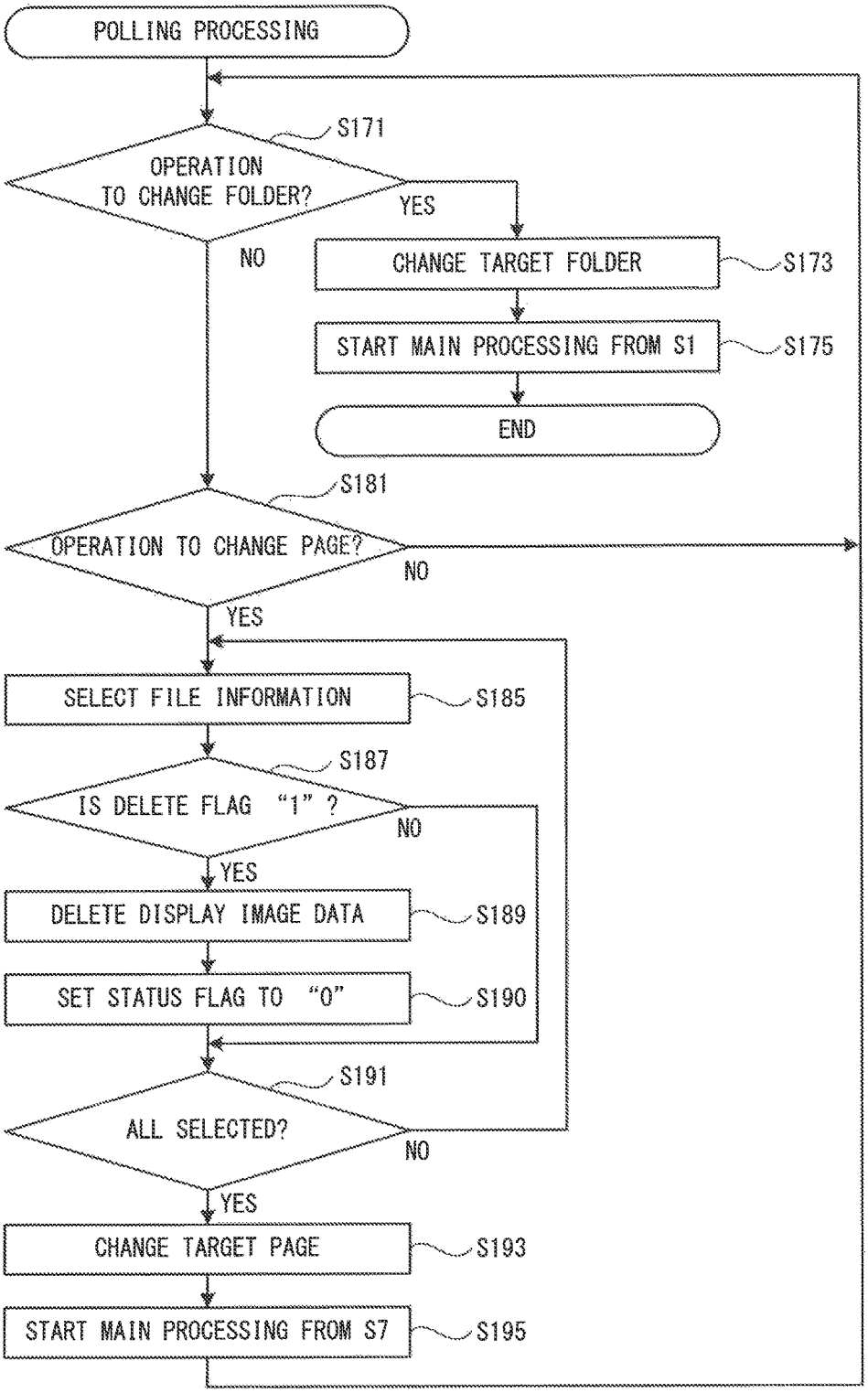
FIG. 11 is a flowchart of polling processing.

The polling processing will be explained with reference to FIG. 11. The polling processing is activated by the processing at step S5 (refer to FIG. 5) of the main processing. The CPU 61 determines whether an operation has been performed to select the hierarchy switching button 54 of the selection screen 151 (refer to FIG. 4) or the inside of the frame 521 including the folder image 52A in the thumbnail image 52 (step S171). When the CPU 61 determines that the operation has been performed to select the hierarchy switching button 54 or the inside of the frame 521 including the folder image 52A in the thumbnail image 52 (yes at step S171), the CPU 61 updates the target folder path in accordance with the operation (step S173). The CPU 61 interrupts the main processing that is being performed in parallel. The CPU 61 causes the main processing to be started again from step S1 (refer to FIG. 5) (step S175). The CPU 61 ends the polling processing.

When the CPU 61 determines that the operation to select the hierarchy switching button 54 has not been performed (no at step S171), the CPU 61 determines whether an operation to select the page switching button 53 has been performed (step S181). When the CPU 61 determines that the operation to select the page switching button 53 has been performed (yes at step S181), the CPU 61 selects one of the pieces of file information corresponding to the folder or the embroidery data acquired by the processing at step S7 (step S185). The CPU 61 determines whether "1" is stored as the delete flag of the file information that has been selected (step S187). When the CPU 61 determines that "1" is stored as the delete flag (yes at step S187), the CPU 61 deletes the display image data of the file information selected by the processing at step S185 (step S189). The CPU 61 stores "0" as the status flag of the file information selected by the processing at step S185 (step S190). The CPU 61 advances the processing to step S191. Meanwhile, when the CPU 61 determines that "0" is stored as the delete flag (no at step S187), the CPU 61 advances the processing to step S191.

The CPU 61 determines whether all of the file information corresponding to the folders or the embroidery data acquired by the processing at step S7 has been selected by the processing at step S185 (step S191). When the CPU 61 determines that the unselected folder or embroidery data is remaining (no at step S191), the CPU 61 returns the processing to step S185. The CPU 61 selects one of the folders or pieces of embroidery data that has not been selected (step S185) and repeats the processing at steps S187 and S189. When the CPU 61 determines that all of the folders or the embroidery data acquired by the processing at step S7 have been selected (yes at step S191), the CPU 61 updates the target page number in accordance with the operation detected by the processing at step S181 (step S193). The CPU 61 interrupts the main processing that is being performed in parallel. On the basis of the updated target page number, the CPU 61 causes the main processing to be started once again from step S7 (refer to FIG. 5) (step S195). The CPU 61 returns the processing to step S171.

Main Operations and Effects of Present Disclosure

As described above, the CPU 61 of the sewing machine 1 acquires the embroidery data stored in the flash memory 64 (step S1). On the basis of the pattern data included in the acquired embroidery data, the CPU 61 displays the selection screen 151 including the pattern image 521B as the thumbnail image 52 on the display 15 (step S41). After displaying the pattern image 521B, the CPU 61 generates the partial images 5211, 5212, and 5213 on the basis of the stitch data included in the acquired embroidery data (steps S151 and S153). The CPU 61 displays each of the generated partial images 5211, 5212, and 5213 in the corresponding portions of the pattern image 521B (step S159). As a result, the pattern image 521B based on the pattern data included in the embroidery data is displayed before generating the partial images 5211, 5212, and 5213 on the basis of the stitch data. Thus, the user can verify in a short period of time the embroidery pattern that can be sewn by the sewing machine 1, without waiting for the partial images 5211, 5212, and 5213 to be displayed. Note that, in the partial images 5211, 5212, and 5213, each of the plurality of stitches representing the embroidery pattern is shown as an image, and thus the resolution can be made higher than that of the pattern image 521B. Thus, by displaying the partial images 5211, 5212, and 5213, and the stitch image 522B as the thumbnail image 52 in place of the pattern image 521B, the CPU 61 can make the appearance of the thumbnail image 52 favorable and, at the same time, the user can verify the details of the embroidery pattern.

Since the CPU 61 causes the selection screen 151 including the plurality of pattern images 521B as the thumbnail image 52 to be displayed on the display 15, the user can be prompted to select, from among the plurality of pattern images, the pattern image corresponding to the embroidery pattern that is the sewing target. In addition, the generation of the partial images 5211, 5212, and 5213 corresponding to each of the pattern images is started after the plurality of pattern images 521B are displayed. Thus, the user can verify the plurality of embroidery patterns that can be sewn by the sewing machine 1 in a shorter period of time than when the processing to display the pattern images and generate the partial images is repeated for each of the embroidery patterns. Further, the CPU 61 causes the images corresponding to the folders or the embroidery data stored directly below the target folder to be displayed in groups of the second predetermined number on the one page of the selection screen 151. Therefore, the user can easily search for the embroidery pattern that is the sewing target, by searching the pattern images while switching the page of the selection screen 151.

When the CPU 61 determines that all of the partial images corresponding to the stitch data have been generated and displayed (yes at step S97), the CPU 61 performs the third expansion processing (step S11). In the third expansion processing, the partial images included as the thumbnail image 52 of the selection screen 151 of a different page to the target page are generated (steps S151 and S153). The generated partial images are stored as the display image data of the file information (step S155). In this way, the CPU 61 can generate and store the pattern images and the partial images before the target page of the selection screen 151 is switched in accordance with the operation being performed to select the page switching button 53. Thus, when the target page of the selection screen 151 is switched, when the data of the already generated partial images is stored as the display image data, the CPU 61 can display the partial images as the thumbnail image 52 of the selection screen 151 of the switched target page, on the basis of this data of the partial images. Thus, the CPU 61 can shorten the period of time required up to displaying the stitch images on the selection screen 151 of the target page after switching. Further, since it is possible to suppress the re-generation of the partial images that have once been generated, the CPU 61 can reduce a processing load required to generate the partial images.

The CPU 61 calculates the number of stitches on the basis of the coordinate data included in the stitch data (step S135). When the CPU 61 determines that the calculated number of stitches is less than the third predetermined number (yes at step S137), the CPU 61 stores "1" as the delete flag (step S139), and when the CPU 61 determines that the number of stitches is equal to or greater than the third predetermined number (no at step S137), the CPU 61 stores "0" as the delete flag (step S141). When the CPU 61 determines that "1" is stored as the delete flag (yes at step S187), the CPU 61 deletes the display image data of the file information (step S189). In other words, the CPU 61 maintains the state in which the partial images are stored as the display image data only when the number of stitches is equal to or greater than the third predetermined number. Note that, the larger the number of stitches of the stitch data, the longer the period of time required when generating the partial images on the basis of this stitch data. In this respect, when the number of stitches is equal to or greater than the third predetermined number, the CPU 61 stores the data of the partial images as the display image data, and when the number of stitches is less than the third predetermined number, the CPU 61 does not store the data of the partial images as the display image data. Thus, the CPU 61 can inhibit a situation in which the user cannot smoothly perform the selection operation of the embroidery pattern due to the long amount of time required to generate the partial images. Further, by suppressing the amount of data of the partial images stored, the CPU 61 can suppress the capacity of the flash memory 64.

When the CPU 61 determines that the stitch lengthwise direction and the pattern lengthwise direction are not aligned with each other (yes at step S113), the CPU 61 generates the partial image that has been rotated by 90 degrees in the counterclockwise direction (step S153), and displays the partial image (step S159). In this case, the CPU 61 can align the orientations of the pattern image and the partial image that replaces the part of the pattern image. Thus, the CPU 61 can make favorable the appearance of the pattern image of which the part is replaced by the partial image. In addition, the CPU 61 generates the partial image after the rotation and stores the rotated partial image in the display buffer, thus causing the rotated partial image to be displayed on the display 15. In this case, the CPU 61 can easily perform the display of the partial image after the rotation.

When the CPU 61 determines that the pattern data from which the pattern image can be generated is not included in the embroidery data (no at step S63), the CPU 61 causes the first standard image 521C to be displayed as the thumbnail image 52 (step S41). Thus, the CPU 61 can notify the user, by the first standard image, that the pattern image cannot be displayed. Further, the CPU 61 generates the partial image on the basis of the stitch data, and displays the partial image in the part of the first standard image 521C corresponding to the partial image (step S159). Therefore, even when the pattern image cannot be displayed, the CPU 61 can allow the user to recognize the embroidery pattern of the sewing target and can prompt the user to perform the selection operation of the embroidery pattern.

Modified Examples

The present disclosure is not limited to the above-described embodiment, and various modifications are possible. The embroidery data may be stored in an external storage medium other than the flash memory 64. Specific examples of the external storage medium are a USB memory, an SD card (registered trademark), and the like. For example, the sewing machine 1 may be provided with a drive device that is connected to the external storage medium. The CPU 61 may read out the embroidery data from the external storage medium connected to the drive device. Further, the selection screen 151 may additionally display a button allowing selection of the flash memory 64 or the external storage medium. The CPU 61 may read out the embroidery data from the flash memory 64 or the external storage medium selected via this button. The size of the frame 521 of the folder image 52A displayed as the thumbnail image 52 and the size of the frames 521 of the other images may be caused be different on the selection screen 151. For example, the frame 521 of the folder image 52A may be smaller than the frames 521 of the other images.

The pattern data includes the plurality of block data representing each of the plurality of blocks forming the pattern image. The CPU 61 generates the pattern image by combining the plurality of images represented by the plurality of block data (step S65). In contrast to this, the pattern data may be data directly representing the pattern image. In this case, the CPU 61 can store the pattern data as the display image data of the selected file information without performing the generation processing of the pattern image by the processing at step S65 (step S67).

The maximum number of the frames 521 included in the thumbnail image 52 of the selection screen 151 is specified by the second predetermined number, and in the case of the above-described embodiment, the second predetermined number is "9." The value stored as the second predetermined number is not limited to "9," and may be another value. Further, the second predetermined number may be settable by the user. In addition, a default value of the second predetermined number may be, for example, a number of the folders or the pieces of embroidery data stored directly under the target folder. In this case, the images corresponding to the folders or the pieces of embroidery data stored directly under the target folder are all displayed on the one page of the selection screen 151. In this state, for example, the user may change the second predetermined number and thus adjust the number of images displayed on the one page of the selection screen 151.

The CPU 61 stores the data of the generated partial images as the display image data of the selected file information (step S155). When the CPU 61 determines that the stitch image has been generated by generating the partial images on the basis of all of the stitch data included in the embroidery data (yes at step S97), the CPU 61 stores "3" as the status flag of the selected file information (step S99). The CPU 61 performs the second expansion processing (step S47) and generates the partial images only when the value of "3" or greater is not stored as the status flag of the selected file information (no at step S45). In other words, the CPU 61 inhibits the partial images from being repeatedly created only when the stitch image has been generated on the basis of all of the stitch data. In contrast to this, even when the stitch image has not been generated, when the partial image that is a part of the stitch image has already been generated, the CPU 61 may inhibit these partial images from being repeatedly generated.

The CPU 61 calculates the number of stitches on the basis of the stitch data (step S135). When the CPU 61 determines that the calculated number of stitches is less than the third predetermined number (yes at step S137), the CPU 61 stores "1" as the delete flag (step S139). In contrast to this, the CPU 61 may change the third predetermined number in accordance with the capacity of the flash memory 64. More specifically, the larger the available capacity of the flash memory 64, the larger the CPU 61 may make the value of the third predetermined number. Thus, the CPU 61 can suppress the capacity of the flash memory 64 from being insufficient due to the generated partial images. Further, the CPU 61 may always store the data of the partial images as the display image data of the selected file information, irrespective of the number of stitches.

The CPU 61 rotates the partial image by 90 degrees in the counterclockwise direction and stores the rotated partial image as the display image data of the selected file information (step S155). In contrast to this, the CPU 61 may store the partial image before the rotation as the display image data of the selected file information. The CPU 61 may rotate the image stored as the display image data by 90 degrees in the counterclockwise direction and store the rotated image in the display buffer. The rotation direction of the partial image may be 90 degrees in the clockwise direction. Further, rotation conditions of the partial image may be selectable by the user.

When the CPU 61 determines that the pattern data from which the pattern image can be generated is not included in the embroidery data (no at step S63), the CPU 61 stores the data of the first standard image as the display image data of the selected file information (step S73) and displays the first standard image on the display 15 (step S41). The CPU 61 generates the partial images on the basis of the stitch data (steps S151 and S153) and displays the generated partial images on the display 15 in place of the first standard image (step S159). In contrast to this, when the CPU 61 determines that the pattern data from which the pattern image can be generated is not included in the embroidery data (no at step S63), the CPU 61 may display only the generated partial images without displaying the first standard image on the display 15. In this case, the CPU 61 may generate the partial images on the basis of the coordinate data corresponding to a predetermined number that is larger than the first predetermined number.

In the third expansion processing, the CPU 61 selects the one page other than the page represented by the target page number, from among the pages in the first file table 60A (refer to FIG. 4). The CPU 61 stores the selected page as the new target page number, and performs the processing at step S7 (refer to FIG. 5), and the display processing (refer to FIG. 6). The CPU 61 may select the page in the following manner. For example, the CPU 61 may store the page closest to the target page number as the new target page number. Further, the CPU 61 may store, as the new target page number, the page that is most frequently displayed on the display 15.

The above-described main processing need not necessarily be performed by the CPU 61 of the sewing machine 1. For example, the main processing may be performed by a CPU of a device (a PC or the like, for example) connected to the sewing machine 1. The selection screen 151 may be displayed on a display portion provided in the device.

What is claimed is:

1. A sewing machine comprising:

a sewing portion configured to sew an embroidery pattern on a cloth, on the basis of stitch data, the stitch data including a position of each of a plurality of stitches representing the embroidery pattern;

a first storage portion configured to store the stitch data and pattern data, the pattern data being data of a pattern image representing the embroidery pattern corresponding to the stitch data;

a display portion configured to display the pattern image;

a processor; and a memory configured to store computer-readable instructions that, when executed by the processor, instruct the processor to perform processes comprising:

first acquiring the stitch data and the pattern data from the first storage portion;

first displaying the pattern image on the display portion on the basis of the pattern data acquired by the first acquiring;

first generating a plurality of partial images representing a number of stitches corresponding to a first predetermined number, on the basis of the stitch data acquired by the first acquiring, after the first displaying of the pattern image on the display portion; and second displaying, each time each of the plurality of partial images is generated by the first generating, the generated partial image on a portion of the pattern image displayed by the first displaying that corresponds to the generated partial image.

2. The sewing machine according to claim 1, wherein the first acquiring includes acquiring the stitch data corresponding to a plurality of the embroidery patterns, and the pattern data corresponding to a plurality of the pattern images, the first displaying includes the displaying of the plurality of pattern images on the display portion, and the first generating includes generating the plurality of partial images corresponding to each of the displayed plurality of pattern images, after the first displaying of the plurality of pattern images on the display portion.

3. The sewing machine according to claim 2, wherein the first displaying includes displaying a plurality of screens on the display portion, one screen at a time, each of the plurality of screens includes a second predetermined number of the pattern images, of the plurality of pattern images, and the first generating includes generating the plurality of partial images corresponding to each of the displayed second predetermined number of pattern images, after the first displaying of the second predetermined number of pattern images, of the plurality of pattern images, on one of the screens.

4. The sewing machine according to claim 3, wherein the computer-readable instructions further instruct the processor to perform a process comprising:

receiving a switching command that switches the screen displayed on the display portion from a first screen to a second screen, the first displaying includes displaying second pattern images on the second screen when the switching command is received after displaying first pattern images on the first screen, the first pattern images being the pattern images of the second predetermined number, and the second pattern images being the pattern images of the second predetermined number other than the first pattern images among the plurality of pattern images; and the computer-readable instructions further instruct the processor to perform a process comprising:

second generating a plurality of second partial images corresponding to the second pattern images, in a state in which the first screen is displayed, after the second displaying of a plurality of first partial images corresponding to the first pattern images displayed on the first screen.

5. The sewing machine according to claim 3, further comprising:

a second storage portion configured to store the plurality of partial images, wherein the computer-readable instructions further instruct the processor to perform processes comprising:

receiving a switching command that switches the screen displayed on the display portion from a first screen to a second screen;

storing the plurality of partial images generated by the first generating in the second storage portion; and first determining, when the switching command is received, whether the plurality of partial images corresponding to each of the pattern images of the second predetermined number displayed on the second screen are stored in the second storage portion, the first generating includes generating the plurality of partial images corresponding to each of the pattern images of the second predetermined number displayed on the second screen, when the first determining determines that the plurality of partial images are not stored in the second storage portion, and the second displaying includes displaying, on the display portion, the plurality of partial images stored in the second storage portion and corresponding to each of the pattern images of the second predetermined number displayed on the second screen, when the first determining determines that the plurality of partial images are stored in the second storage portion, and displaying, on the display portion, the plurality of partial images generated in the first generating and corresponding to each of the pattern images of the second predetermined number displayed on the second screen, when the first determining determines that the plurality of partial images are not stored in the second storage portion.

6. The sewing machine according to claim 5, wherein the computer-readable instructions further instruct the processor to perform processes comprising:

calculating a number of the stitches for each of the embroidery patterns on the basis of the stitch data; and second determining whether the calculated number of the stitches is equal to or greater than a third predetermined number, and the storing includes storing the plurality of partial images generated by the first generating in the second storage portion, when the second determining determines that the number of the stitches is equal to or greater than the third predetermined number.

7. The sewing machine according to claim 1, wherein the computer-readable instructions further instruct the processor to perform a process comprising:

third determining, on the basis of the stitch data and the embroidery data acquired by the first acquiring, whether an orientation of the embroidery pattern matches an orientation of the pattern image, and the second displaying includes displaying the plurality of partial images rotated under rotation conditions necessary for the orientation of the embroidery pattern to match the orientation of the pattern image, when the third determining determines that the orientation of the embroidery pattern does not match the orientation of the pattern image.

8. The sewing machine according to claim 7, wherein when the third determining determines that the orientation of the embroidery pattern does not match the orientation of the pattern image, the first generating includes generating the partial images rotated under the rotation conditions.

9. The sewing machine according to claim 1, wherein the computer-readable instructions further instruct the processor to perform processes comprising:

second acquiring only the stitch data when the pattern data associated with the stitch data is not stored in the first storage portion;

third displaying a predetermined image on the display portion;

third generating the plurality of partial images on the basis of the stitch data acquired by the second acquiring, after the third displaying of the predetermined image on the display portion; and fourth displaying the generated plurality of partial images, in place of the predetermined image displayed by the third displaying, each time each of the plurality of partial images is generated by the third generating.

10. The sewing machine according to claim 1, wherein the first generating includes generating the partial image of a higher resolution than the pattern image.

11. A non-transitory computer-readable medium storing computer-readable instructions that are executed by a processor provided in a sewing machine comprising a sewing portion, the sewing portion sewing an embroidery pattern on a cloth, on the basis of stitch data specifying a position of each of a plurality of stitches representing the embroidery pattern, a first storage portion, the first storage portion storing the stitch data and pattern data, and the pattern data being data of a pattern image representing the embroidery pattern corresponding to the stitch data, and a display portion, the display portion displaying the pattern image, the computer-readable instructions, when executed, instructing the processor to perform processes comprising:

first acquiring the stitch data and the pattern data from the first storage portion;

first displaying the pattern image on the display portion on the basis of the pattern data acquired by the first acquiring;

first generating a plurality of partial images representing a number of stitches corresponding to a first predetermined number, on the basis of the stitch data acquired by the first acquiring, after the first displaying of the pattern image on the display portion; and second displaying, each time each of the plurality of partial images is generated by the first generating, the generated partial image on a portion of the pattern image displayed by the first displaying that corresponds to the generated partial image.

* * * * *